US008228162B2

(12) United States Patent
Yoshihara et al.

(10) Patent No.: US 8,228,162 B2
(45) Date of Patent: Jul. 24, 2012

(54) PRESSURE SENSITIVE SWITCH AND INPUT DEVICE USING PRESSURE SENSITIVE SWITCH

(75) Inventors: Satoshi Yoshihara, Hyogo (JP); Masaki Sawada, Osaka (JP); Hisanori Kusunoki, Osaka (JP); Hiroto Inoue, Kyoto (JP)

(73) Assignee: Panasonic Corporation, Osaka (JP)

( * ) Notice: Subject to any disclaimer, the term of this patent is extended or adjusted under 35 U.S.C. 154(b) by 218 days.

(21) Appl. No.: 12/789,852

(22) Filed: May 28, 2010

(65) Prior Publication Data

US 2010/0301925 A1 Dec. 2, 2010

(30) Foreign Application Priority Data

Jun. 2, 2009 (JP) ..... 2009-132820
Nov. 24, 2009 (JP) ..... 2009-265969

(51) Int. Cl.
*H01C 10/10* (2006.01)

(52) U.S. Cl. ..... 338/47; 338/99; 200/5 R; 200/511; 345/161

(58) Field of Classification Search ..... 338/99, 338/118, 47; 200/1 R, 4, 5 R, 6 A, 511, 252; 345/161; 463/36, 37
See application file for complete search history.

(56) References Cited

U.S. PATENT DOCUMENTS 6,080,941 A * 6/2000 Yokobori ..... 200/6 A
6,525,279 B2 * 2/2003 Sato ..... 200/6 A
6,653,579 B2 * 11/2003 Inoue et al. ..... 200/6 A
6,750,408 B2 * 6/2004 Inoue et al. ..... 200/6 A
6,794,982 B2 * 9/2004 Inoue et al. ..... 338/47
7,161,583 B2 * 1/2007 Okada et al. ..... 345/157
7,960,667 B2 * 6/2011 Yoshihara et al. ..... 200/516
2010/0045593 A1 2/2010 Wahio et al.

FOREIGN PATENT DOCUMENTS

CN 1438664 A 8/2003
JP 2003-242862 A 8/2003
JP 2009-016330 A 1/2009
WO WO 2008/072506 A1 6/2008

* cited by examiner

*Primary Examiner* — Kyung Lee
(74) *Attorney, Agent, or Firm* — RatnerPrestia

(57) ABSTRACT

There is provided a pressure sensitive switch including: a cover; a slide portion that is stored in the cover and is slidable by being pressed in a horizontal direction; a pressing unit including a pressure portion that has an inner side face brought into contact with the slide portion and can be moved by being pressed by the slide potion; a sheet resistive body that has an upper face brought into contact with the pressing unit; and a conductive plate that is disposed on the lower side of the sheet resistive body with a predetermined gap arranged therebetween. The slide portion is slidable within a horizontal plane, and the pressing portion presses the sheet resistive body by sliding the slide portion, and a resistance value between the sheet resistive body and the conductive plate changes in accordance with a change in a slide operation force for sliding the slide portion.

8 Claims, 18 Drawing Sheets

PRESSURE SENSITIVE SWITCH AND INPUT DEVICE USING PRESSURE SENSITIVE SWITCH

BACKGROUND OF THE INVENTION

1. Field of the Invention

The present invention relates to a pressure sensitive switch used mainly for operating various electronic devices and an input device using the pressure sensitive switch.

2. Description of the Related Art

Recently, in accordance with improved functions and diversification of various electronic devices such as cellular phones and car navigation devices, pressure sensitive switches used in such operations and input devices using the pressure sensitive switches require a high operation speed and easiness for use.

Such conventional pressure sensitive switches and input devices using the pressure sensitive switch will be described with reference to FIGS. 20 to 22. For easy understanding of the configuration thereof, in the diagrams, the size in the thickness direction is represented with being enlarged.

FIG. 20 is a cross-sectional view of a conventional pressure sensitive switch, and FIG. 21 is an exploded perspective view of the conventional pressure sensitive switch. In FIGS. 20 and 21, movable contact point 2 having an approximate dome shape is bonded to the lower face of film-shaped cover sheet 1 by using an adhesive agent (not shown).

Movable contact point 2 can be bonded to five places of an approximate center position on film-shape base sheet 3 having flexibility, which is the same as that of cover sheet 1, and the front, rear, left, and right sides thereof by cover sheet 1.

Movable contact assembly 6 is configured by cover sheet 1, movable contact point 2, base sheet 3, sheet resistive body 4 located on the lower face thereof, and insulating layer 5 disposed in an area acquired by excluding a portion that becomes the center on the lower side of movable contact point 2.

On the upper and lower faces of substrate 7 having a film shape or a plate shape, a plurality of wiring patterns (not shown) are formed with copper foil or the like. In five places of an approximate center position of substrate 7 and positions located on the front, rear, left, and right side thereof, fixed contact point pair 8 is formed. Fixed contact point pair 8 is formed by opposing fixed contact points 8A and 8B having a half circle shape with a predetermined gap interposed therebetween.

On the upper side of each fixed contact point pair 8, movable contact assembly 6 is placed so as to face a portion of sheet resistive body 4 that is not covered with insulating layer 5 through a predetermined gap, whereby the pressure sensitive switch is configured.

In addition, on the upper face of substrate 7, electronic circuit 12 that is configured by constant voltage power supply 9, resistor 10, control unit 11, and the like is disposed. Constant voltage power supply 9 is connected to fixed contact point 8A. Control unit 11 is connected to fixed contact point 8B. Resistor 10 has one end connected to fixed contact point 8B and the other end connected to the ground. The input device is configured as described above. Control unit 11 is configured by a microcomputer or the like.

On the upper side of movable contact assembly 6, rubber sheet 13 formed from insulating resin, pressure button 14 formed from insulating resin, and operation body 15 formed from insulating resin are disposed. Rubber sheet 13 has a plurality of pressing portions 13A on the lower face thereof, and pressing portions 13A are brought into contact with the upper face of cover sheet 1 located in the center portion of the plurality of movable contact points 2. On the upper side of pressing portions 13A, pressure button 14 is disposed so as to be movable in the vertical direction, and operation body 15 is disposed so as to be able to rock.

In the above-described configuration, for example, when the pressure button 14 located at the center is pressed in the downward direction, the center of rubber sheet 13 is bent so as to press movable contact point 2 located on the lower side thereof. At that time, movable contact point 2 is elastically inverted in the downward direction with the sense of clicking given to the user. Accordingly, sheet resistive body 4 is bent in the downward direction, and the lower face of sheet resistive body 4 is brought into contact with fixed contact points 8A and 8B, whereby fixed contact points 8A and 8B are electrically connected to each other through sheet resistive body 4.

Thereafter, when the pressing force is further applied, sheet resistive body 4 is further bent in accordance with the pressing force. Accordingly, contact areas between the sheet resistive body 4 and fixed contact points 8A and 8B are increased, and thereby a resistance value between fixed contact points 8A and 8B decreases.

In addition, when operation body 15 is rocked by pressing the front, rear, left, and right sides of operation body 15, movable contact point 2 located on the lower side of the pressing position is elastically inverted in the downward direction with the sense of clicking incurred, similarly to the case of pressing the pressure button 14 located at the center. Accordingly, sheet resistive body 4 is bent in the downward direction, and the lower face of sheet resistive body 4 is brought into contact with fixed contact points 8A and 8B located on the lower side of each pressing position. Therefore, fixed contact points 8A and 8B are electrically connected to each other through sheet resistive body 4.

Then, when the pressing force is further applied, sheet resistive body 4 is further bent in accordance with the pressing force. Thus, the contact areas between sheet resistive body 4 and fixed contact points 8A and 8B are increased, and the resistance value between fixed contact points 8A and 8B decreases, which is the same as the case of pressing pressure button 14 located at the center.

The change in the resistance value is detected by control unit 11 of electronic circuit 12 that is formed on the upper face of substrate 7 through constant voltage power supply 9 and resistor 10 as a change in the voltage. Based on the change in the voltage, for example, as shown in the perspective view of an electronic device of FIG. 22, the movement direction or movement speed of pointer 19 used for selecting a plurality of menus 18 displayed in display means 17 of cellular phone 16 are controlled by control unit 11.

In other words, when position A located on the right side of operation body 15 is pressed, control unit 11 controls pointer 19 to move to the right side in accordance with the pressing operation. On the other hand, when position B located on the left side is pressed, control unit 11 controls pointer 19 to move to the left side in accordance with the pressing operation. In addition, when the pressing force applied to operation body 15 is strong, control unit 11 controls pointer 19 to move at a higher speed.

As a related art relating to the present invention, for example, Japanese Patent Unexamined Publication No. 2009-016330 is known.

However, in the above-described conventional pressure sensitive switch and the input device using the pressure sensitive switch, for example, in order to reversely move the cursor, which has been moved in the rightward direction, in the leftward direction, the finger pressing the right end portion of operation body 15 needs to be departed once and press the left end portion thereof. Accordingly, the pressing position of operation body 15 needs to be checked by moving the operator's eyes off the screen once. Therefore, there is a problem in that a smooth operation is disturbed.

SUMMARY OF THE INVENTION

The present invention provides a pressure sensitive switch capable of performing various operations in a simple manner and an input device using the pressure sensitive switch.

According to an embodiment of the present invention, there is provided a pressure sensitive switch including: a cover; a slide portion that is stored in the cover and is slidable by being pressed in a horizontal direction; a pressing unit including a pressure portion that has an inner side face brought into contact with the slide portion and can be moved by being pressed by the slide potion; a sheet resistive body that has an upper face brought into contact with the pressing unit; and a conductive plate that is disposed on the lower side of the sheet resistive body with a predetermined gap arranged therebetween. The slide portion is slidable within a horizontal plane. The pressing portion presses the sheet resistive body by sliding the slide portion, and a resistance value between the sheet resistive body and the conductive plate changes in accordance with a change in a slide operation force for sliding the slide portion. When a slide operation is performed by pressing down the center of the slide portion with a finger or the like, the sliding direction within a horizontal plane and the slide operation force can be determined based on a resistance value between the sheet resistive body and the conductive plate. Accordingly, even when the movement direction of the cursor displayed in the display means is revered from the rightward direction to the leftward direction, a smooth operation can be performed with the center slide portion is maintained to be operated. Accordingly, there is an advantage in that a pressure sensitive switch capable of performing various operations in a simple manner can be acquired.

According to another embodiment of the present invention, there is provided an input device including: the above-described pressure sensitive switch; a switch unit that is connected to the pressure sensitive switch; a control unit that is connected to the pressure sensitive switch and the switch unit; and a constant voltage power supply of a predetermined voltage. A terminal of the pressure sensitive switch that is connected to the sheet resistive body is connected to the constant voltage power supply, and a terminal of the pressure sensitive switch that is connected to the conductive plate is connected to the control unit, and the control unit estimates a pressing direction in which the sheet resistive body is pressed based on an input voltage input to the control unit through the conductive plate. Accordingly, a specific voltage distribution changing in accordance with a change in the direction in which the operator presses is formed in the sheet resistive body. Therefore, the direction in which the operator presses can be detected with high accuracy, and there is an advantage in that an input device capable of various operations can be acquired.

As described above, according to the present invention, a pressure sensitive switch capable of performing various operations in a simple manner and an input device using the pressure sensitive switch can be realized.

DETAILED DESCRIPTION OF THE PREFERRED EMBODIMENTS

Hereinafter, embodiments of the present invention will be described with reference to FIGS. 1 to 19. To each configuration that is the same as that described in the section of "BACKGROUND OF THE INVENTION", the same reference sign is attached, and the description thereof is simplified. Among these drawings, in cross-sectional views, the size is enlarged in the thickness direction for easy understanding of the configuration.

Embodiment 1

Figure 1:
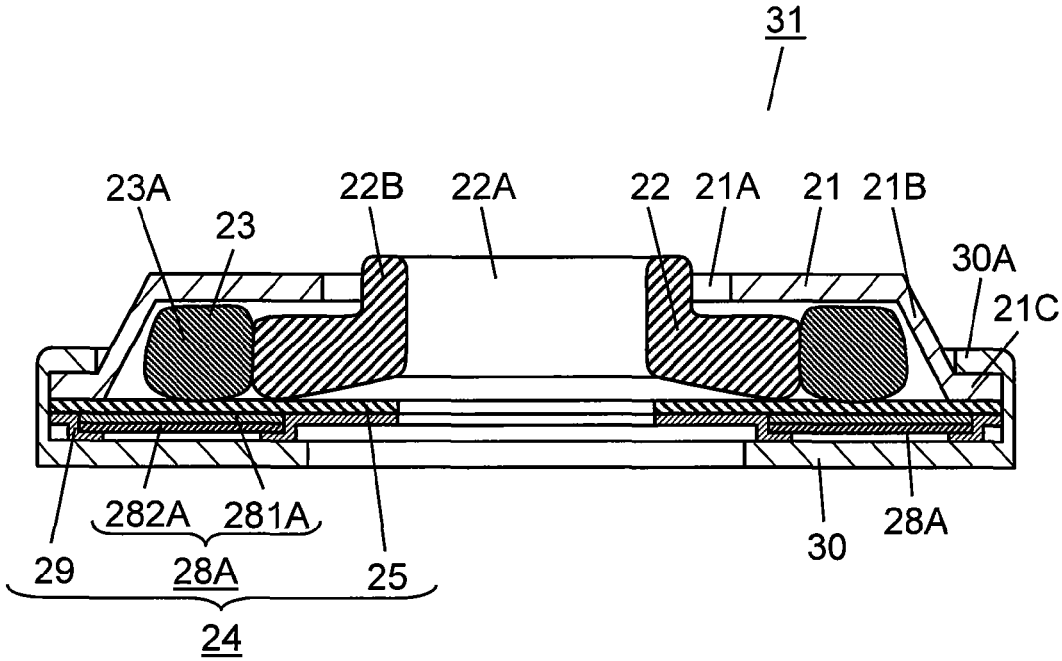
FIG. 1 is a cross-sectional view of a pressure sensitive switch according to Embodiment 1 of the present invention.

FIG. 1 is a cross-sectional view of a pressure sensitive switch according to Embodiment 1 of the present invention.

Figure 2:
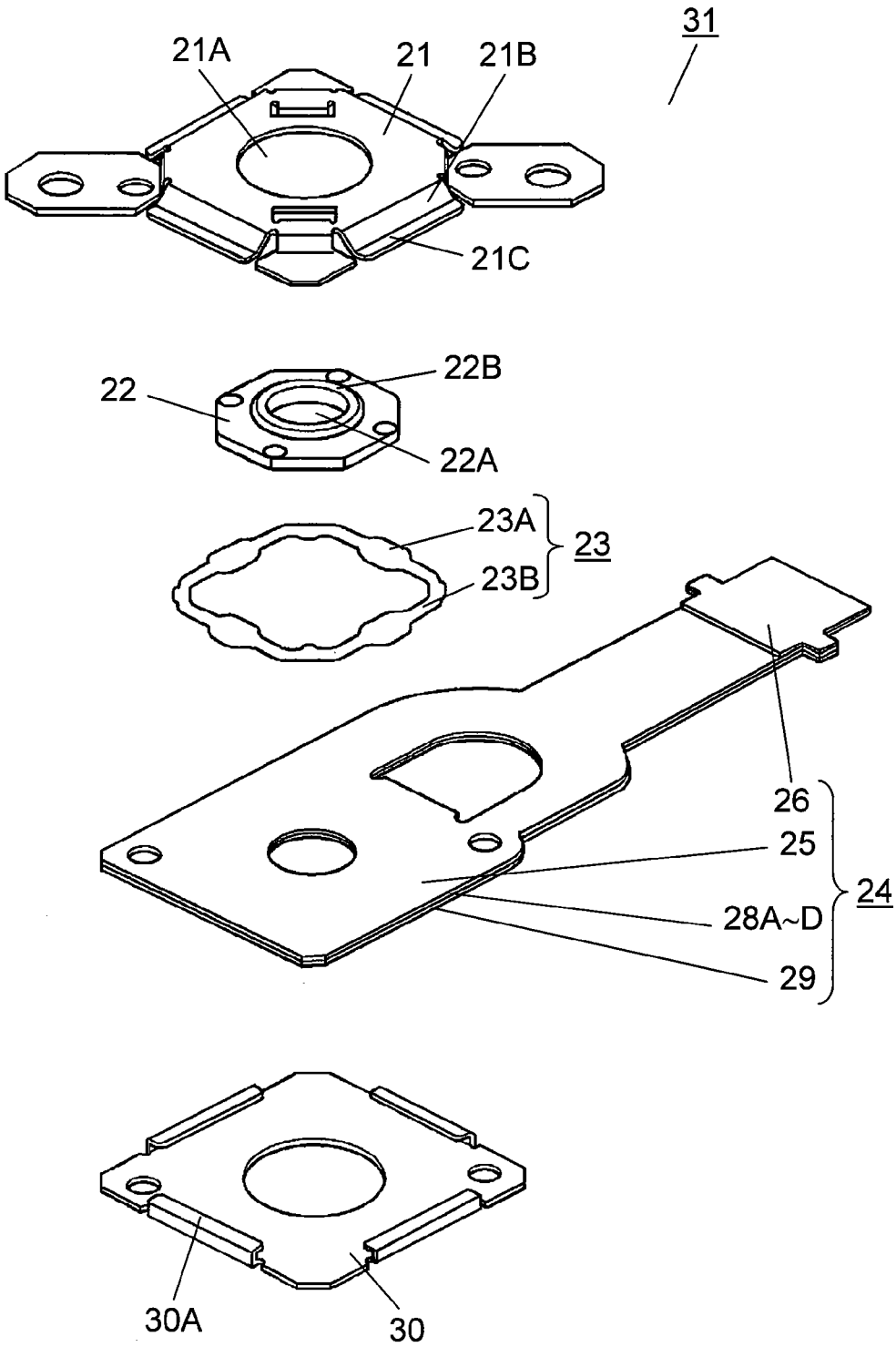
FIG. 2 is an exploded perspective view of the pressure sensitive switch according to Embodiment 1 of the invention.

FIG. 2 is an exploded perspective view of the pressure sensitive switch according to Embodiment 1 of the invention. As shown in FIGS. 1 and 2, cover 21 that is formed from metal such as stainless steel has an open lower face side. Circular hole 21A is formed at the center of the top face of cover 21, and on the inner face of cover 21, inclined face portion 21B that forms an inclined face broadened toward the outer side is disposed. In the outer frame of inclined face portion 21B, frame portion 21C that protrudes in a direction parallel to the top face is formed.

In addition, slide portion 22, which is made of insulating resin such as nylon, formed in an octagon shape in the top view is stored in cover 21 in the lower direction of cover 21. In addition, on the approximate center of slide portion 22, circular hole 22A that has an opening area smaller than that of circular hole 21A is disposed. On the outer circumference of circular hole 22A, convex portion 22B is disposed. Slide portion 22 and cover 21 are combined together with a predetermined gap formed between the outer circumferential side of convex portion 22B and the inner circumferential side of circular hole 21A.

In other words, slide portion 22 is combined with cover 21 so as to be stored therein for being slidable in all the horizontal directions inside cover 21.

In addition, pressing unit 23 made of insulating resin such as nylon is formed by pressing portions 23A that are formed in four places located on the front, rear, left, and right sides in the shape of an approximately rectangular parallelepiped shape and rim portions 23B that are combined with pressing portions 23A so as to be formed in a ring shape. Rim potion 23B is formed so as to have the width narrower than that of pressing portion 23A. Pressing unit 23 is combined with slide portion 22 such that the inner side thereof formed in the ring shape surrounds slide portion 22.

Pressing portion 23A has an upper end of the outer side formed in a curved shape and an inner face being brought into contact with the outer circumference of slide portion 22. Then, pressing portions 23A are disposed on the front, rear, left, and right sides of slide portion 22. Accordingly, both slide portion 22 and pressing portion 23A are configured to be slidable.

In addition, pressing unit 23 is latched with cover 21 through connection pins (not shown) or the like in an approximate center position of each rim portion 23B. Thus, when pressing portion 23A is slid by being pressed by slide portion 22, rim portion 23B adjacent to pressed pressing portion 23A is broadened, and a structure in which an elastic recovery force is stored is formed. Then, when the pressing force applied to slide portion 22 disappears, pressing portion 23A and slide portion 22 returns to their normal positions in accordance with the stored elastic recovery force.

In addition, to the lower side of slide portion 22 and pressing unit 23, pressure sensitive conduction unit 24 is disposed so as to have its top face brought into contact with slide portion 22 and pressing unit 23.

Figure 3:
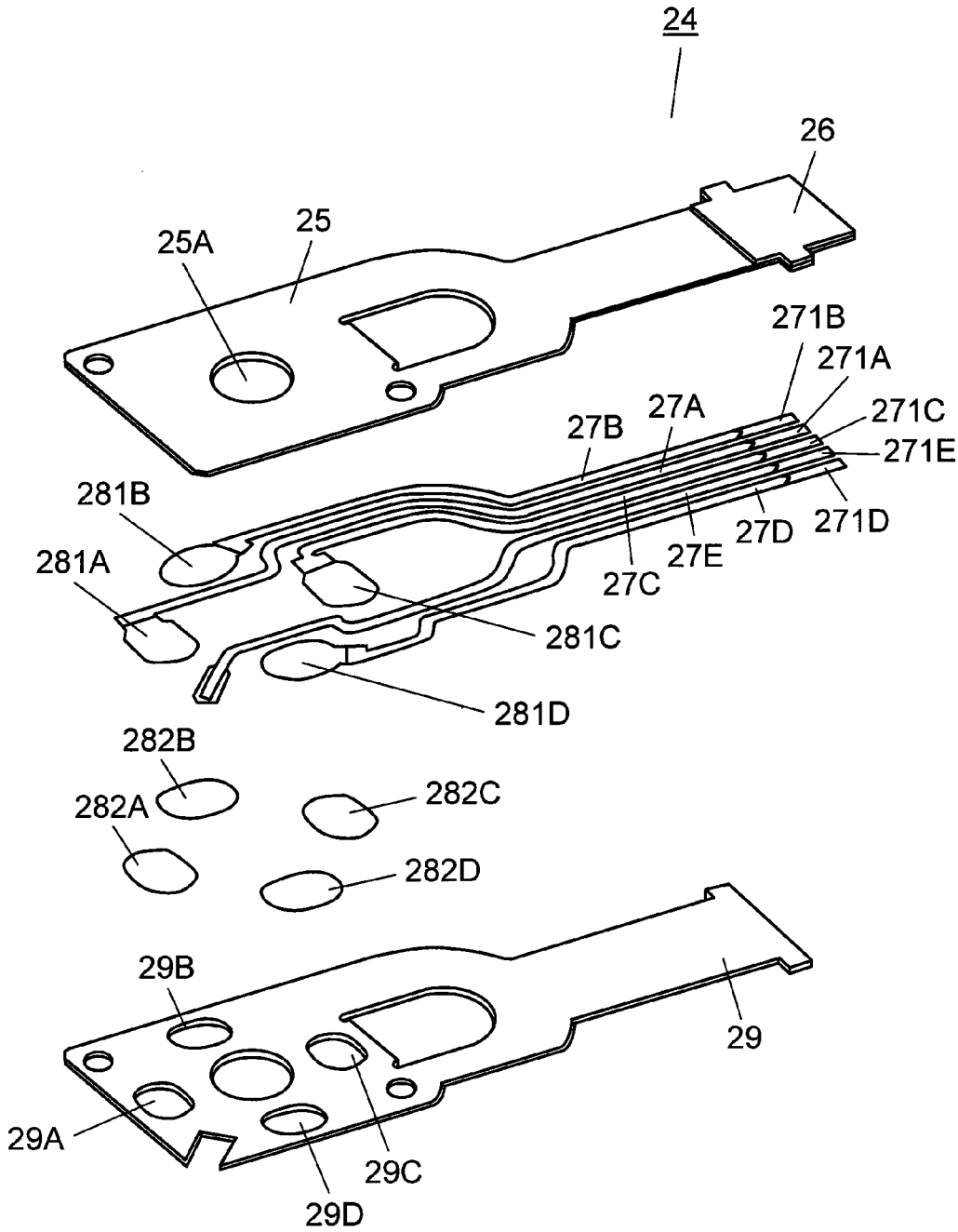
FIG. 3 is an exploded perspective view of a pressure sensitive conduction unit according to Embodiment 1.

Here, the structure of pressure sensitive conduction unit 24 will be described in detail with reference to FIG. 3. FIG. 3 is an exploded perspective view of the pressure sensitive conduction unit according to Embodiment 1.

Base sheet 25 is formed to have one end positioned on the right side to extend. Base sheet 25 includes circular hole 25A located in an approximate center position of the left half face thereof and connector cover 26, which is made of insulating resin, located on the right end of the extended base sheet. Base sheet 25 is formed of a flexible film having flexibility such as polyethyleneterephthalate, polycarbonate, or polyimide.

In addition, on the lower face of base sheet 25, a plurality of lines 27A to 27E are disposed. The plurality of lines 27A to 27E are formed by printing a conductive material such as silver paste or processing conductive metal by using an etching process, a press process, or the like. In one end portions (in FIG. 3, the right end portions) of the lines, connector terminals 271A to 271E are formed, and connector terminals 271A to 271E are attached to the lower face of connector cover 26.

To the other end portions (in FIG. 3, the left end portions) of lines 27A to 27D connected to connector terminals 271A to 271D, low resistive body layers 281A to 281D, which are formed by dispersing carbon powers inside a synthetic resin, having sheet resistance values of 0.5 kΩ/μm to 30 kΩ/μmare connected. Low resistive body layers 281A to 281D are printed on the lower face of base sheet 25 so as to be formed in four positions on the front, rear, left and right sides of circular hole 25A so as to surround circular hole 25A.

In addition, the other end portion (in FIG. 3, the left end portion) of line 27E connected to connector terminal 271E extends to the periphery of the left end of the lower face of base sheet 25.

On the lower faces of low resistive body layers 281A to 281D, high resistive body layers 282A to 282D having sheet resistance values of 50 kΩ/μm to 5 MΩ/μm are printed so as to be formed in an overlapping manner. Sheet resistive bodies 28A to 28D are configured by low resistive body layers 281A to 281D and high resistive body layers 282A to 282D.

In addition, insulating layer 29 is disposed on the lower side of the plurality of lines 27A to 27E, sheet resistive bodies 28A to 28D, and connector terminals 271A to 271E described above. Insulating layer 29 and base sheet 25 are attached to each other so as to pinch the plurality of lines 27A to 27E, sheet resistive bodies 28A to 28D, and connector terminals 271A to 271E therebetween in the vertical direction, whereby pressure sensitive conduction unit 24 is formed. In addition, insulating layer 29 includes slightly small circular holes 29A to 29D so as to expose the center portion of the lower face of high resistive body layers 282A to 282D. The right ends of connector terminals 271A to 271E are exposed to the lower side of connector cover 26 without the lower face side thereof being covered with insulating layer 29.

As shown in FIG. 2, to the lower side of insulating layer 29, conductive plate 30, which has conductivity, formed in an approximately square shape from stainless steel, brass, or the like that is coated with gold, nickel, or the like is disposed so as to face sheet resistive bodies 28A to 28D that are disposed at least in four positions. In addition, the left end of connector terminal 271E of pressure sensitive conduction unit 24 is connected to conductive plate 30.

In addition, conductive plate 30 faces the exposed lower faces of sheet resistive bodies 28A to 28D through a gap of about 10 to 100 μm. For example, sheet resistive body 28A will be described as an example. As shown in the partial cross-sectional view of FIG. 4, on the lower face of high resistive body layer 282A that is printed so as to be formed on the lower face of low resistive body layer 281A, delicate asperities are formed over the entirety of each face. When sheet resistive body 28A is bent, a structure in which the contact area between high resistive body layer 282A and conductive plate 30 changes in accordance with the bent state is formed.

As described above, slide portion 22 and pressing unit 23 that are stored in cover 21 are placed on the upper face of pressure sensitive conduction unit 24, conductive plate 30 is disposed on the lower side thereof, and outer frame portion 21C of cover 21 and the end portion of base sheet 25 disposed on the lower side of outer frame portion 21C are pinched by lock portion 30A, which has the shape of "U", disposed on the outer edge of conductive plate 30, whereby pressure sensitive switch 31 is configured.

Figure 5:
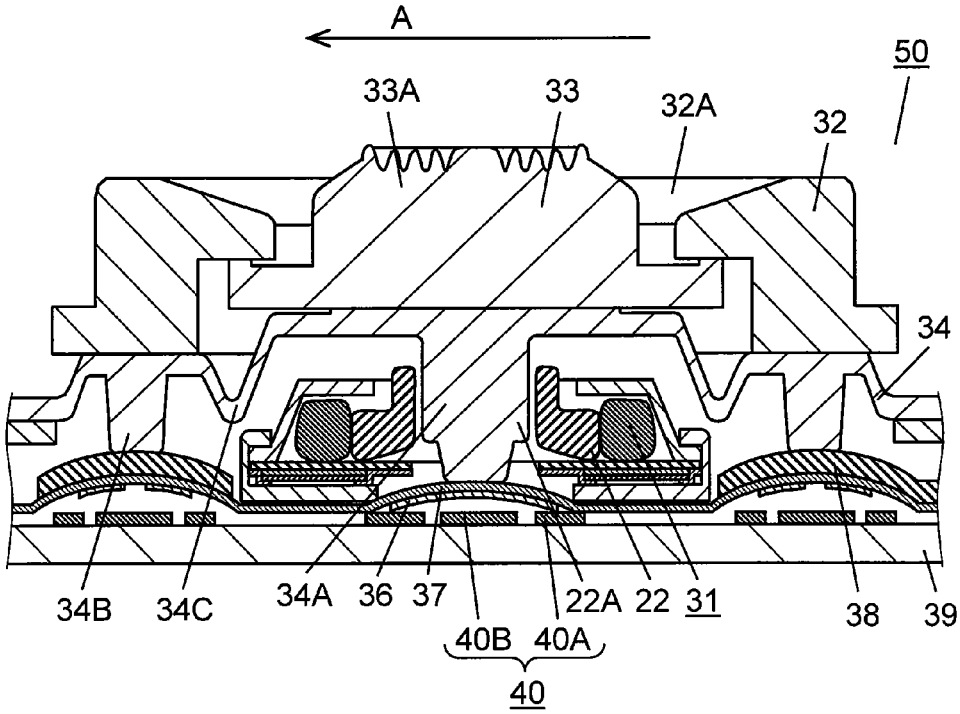
FIG. 5 is a cross-sectional view of an input device using the pressure sensitive switch according to Embodiment 1 of the invention.
Figure 6:
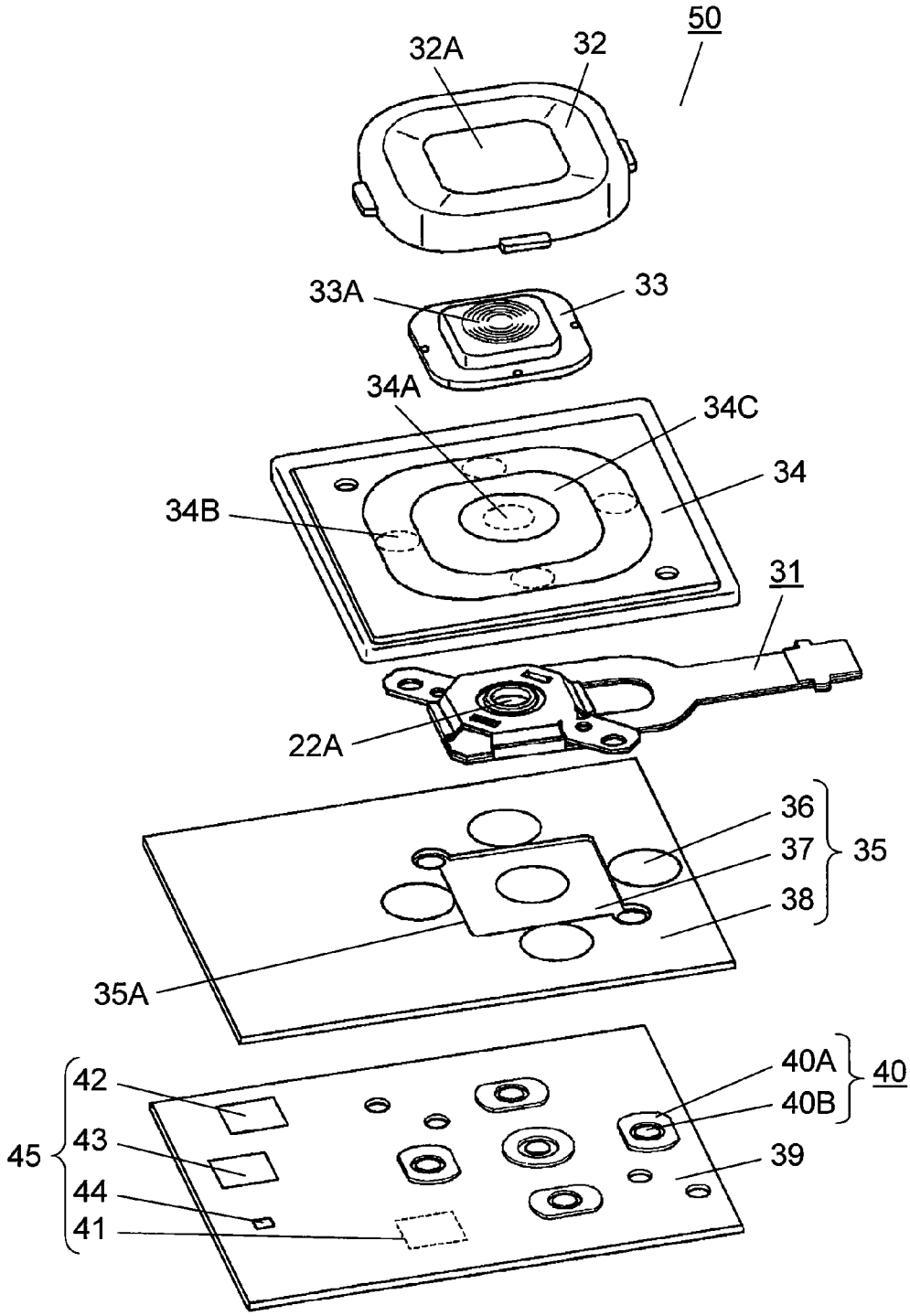
FIG. 6 is an exploded perspective view of the input device using the pressure sensitive switch according to Embodiment 1 of the invention.

Such pressure sensitive switch 31 is built in an electronic device such as a cellular phone so as to form an input device. The configuration of the input device according to Embodiment 1 will be described with reference to FIGS. 5 and 6. FIG. 5 is a cross-sectional view of the input device according to Embodiment 1. FIG. 6 is an exploded perspective view of the input device according to Embodiment 1.

On the upper face of pressure sensitive switch 31, auxiliary button 32 that is formed from insulating resin, operation body 33 that is formed from insulating resin, and pressure button rubber 34 that is formed from an elastic material such as silicon or elastomer are sequentially placed.

Auxiliary button 32 has an approximately square shape viewed from the top and has angular hole 32A disposed at the center thereof. Auxiliary button 32 is combined with operation body 33 such that operation portion 33A of operation body 33 is exposed from angular hole 32A.

In addition, pressure button rubber 34 is arranged on the upper side of pressure sensitive switch 31. Pressure button rubber 34 includes movable portion 34A, pressing portion 34B, and rim portion 34C. Movable portion 34A is inserted into circular hole 22A of slide portion 22 of pressure sensitive switch 31. Pressing portion 34B is formed in correspondence with four places positioned on the front, rear, left, and right sides of auxiliary button 32 on the periphery of movable portion 34A. Rim portion 34C that is thin and connected between movable portion 34A and pressing portion 34B.

In addition, the lower faces of auxiliary button 32 and operation body 33 are attached to the upper face of pressure button rubber 34 by using an adhesive agent (not shown) or the like. On the lower face of four places located on the front, rear, left, and right sides of auxiliary button 32, pressing portions 34B are located. At the center of the lower face of operation body 33, movable portion 34A is located.

In other words, operation body 33 is configured so as to be able to slide inside angular hole 32A of auxiliary button 32 and to press movable portion 34A in the downward direction. Auxiliary button 32 is configured to be able to press pressing portions 34B located in four places, which are located on the front, rear, left, and right sides thereof, in the downward direction.

In the lower portion of pressure sensitive switch 31, movable contact point body sheet 35 is disposed. Movable contact point body sheet 35 is configured by attaching light guiding sheet 38, which is formed from insulating resin, film 37, formed from an insulating resin material by using an adhesive agent (not shown) or the like, and movable contact points 36. Movable contact points 36 attached to the lower face of film 37, are made from conductive metal, and having a cup shape. Movable contact point body sheet 35 is allowing light incident from the end face to be emitted in a predetermined place to the upper face of film 37. At the center of movable contact point body sheet 35, rectangle hole 35A formed by cutting out a rectangular portion of light guiding sheet 38 is disposed. In rectangle hole 35A, pressure sensitive switch 31 is inserted, and the lower face of pressure sensitive switch 31 is brought into contact with the upper face of film 37 so as to be fixed.

In addition, movable contact points 36 disposed on the lower face of film 37 are attached to five places located on the front, rear, left, right, and center sides of rectangle hole 35A. Center movable contact point 36 is disposed on the lower side of movable portion 34A, and front, rear, left, and right movable contact points 36 are disposed on the lower side of pressing portions 34B.

In addition, on the lower face of movable contact point body sheet 35, substrate 39 in the shape of a film formed from polyethyleneterephthalate, polycarbonate, or the like or in the shape of a plate formed from paper phenol, glass epoxy, or the like is disposed.

On the upper and lower faces of substrate 39, a plurality of wiring patterns (not shown) are formed with a copper foil or the like. In addition, on the upper face of substrate 39, fixed contact point pair 40 that is configured by fixed contact point 40A having a ring shape and a circular fixed contact point 40B formed at the center of fixed contact point 40A is formed from carbon, silver, copper foil, or the like. Fixed contact point pairs 40 are disposed in five places located on the front, rear, left, right, and center sides. Center fixed contact point pair 40 is disposed on the lower side of movable portion 34A, and front, rear, left, and right fixed contact point pairs 40 are disposed on the lower side of pressing portion 34B.

In other words, operation body 33 is configured so as to press movable portion 34A in the downward direction and bring center movable contact point 36 into contact with fixed contact point pair 40. Simultaneously, auxiliary button 32 is configured so as to press pressing portions 34B located in four positions on the front, rear, left, and right sides and bring front, rear, left, and right movable contact points 36 into contact with fixed contact point pair 40.

In addition, on the lower face of substrate 39, connection connector 41, which is made of insulating resin, connected to connector terminals 271A to 271E of pressure sensitive switch 31 is disposed. A connector terminal (not shown), which is made of metal, disposed on connection connector 41 is connected to electronic circuit 45 that is configured by constant voltage power supply 42, control unit 43 formed by a semiconductor device such as a microcomputer, resistor 44, and the like through a wiring pattern. As described above, input device 50 is configured.

Figure 4:
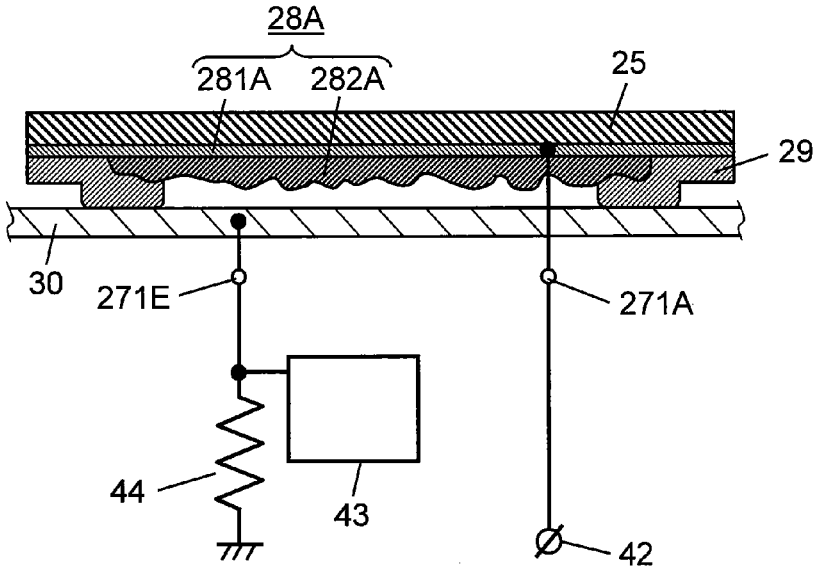
FIG. 4 is a partial cross-sectional view of the pressure sensitive conduction unit according to Embodiment 1 of the invention.

For example, when contact resistance between sheet resistive body 28A and conductive plate 30 is measured, as shown in FIG. 4, resistor 44 having one end connected to the ground is connected to control unit 43 in parallel so as to be connected to conductive plate 30 through connector terminal 271E. Accordingly, a voltage is applied from constant voltage power supply 42 through connector terminal 271A, and the voltage divided in accordance with the contact resistance value between sheet resistive body 28A and conductive plate 30 and the resistance value of resistor 44 is input to control unit 43.

Figure 7:
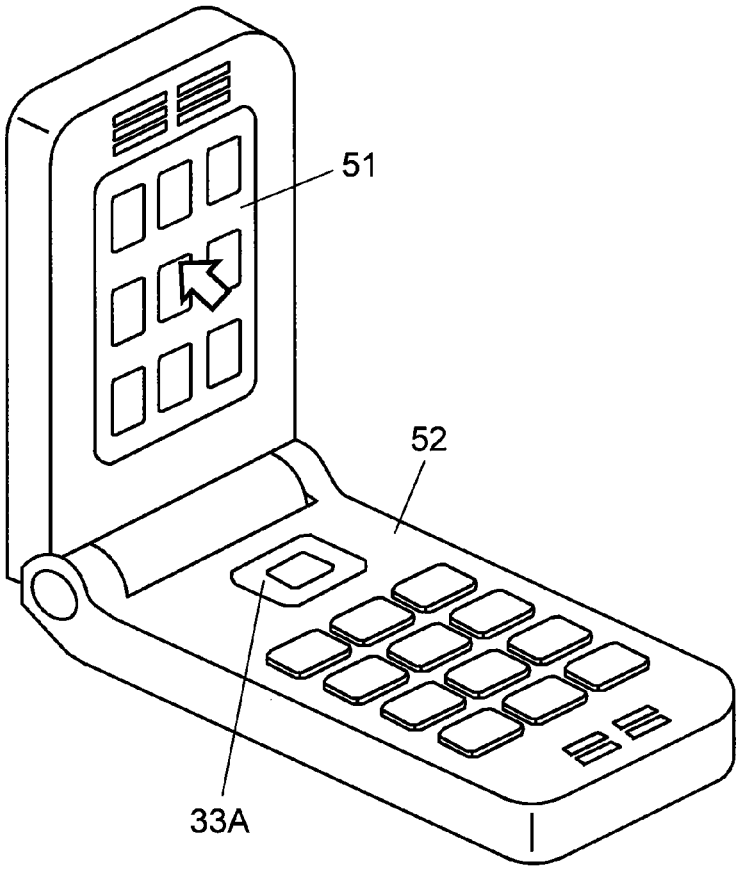
FIG. 7 is a perspective view of an electronic device using the pressure sensitive switch according to Embodiment 1 of the invention.
Figure 8:
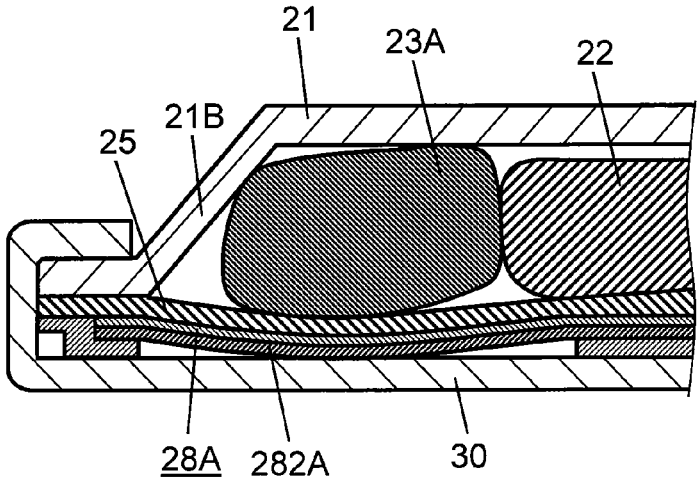
FIG. 8 is a partial cross-sectional view of the pressure sensitive switch according to Embodiment 1 of the invention at the time of a slide operation.

As shown in FIG. 7, for example, the input device 50 configured as described above is mounted on the upper face of electronic device 52, including display means 51 with operation portion 33A thereof being exposed. When a slide operation is performed by bringing a finger into contact with operation portion 33A of operation body 33, for example, in a leftward direction denoted by arrow A shown in FIG. 5, as shown in the cross-sectional view of FIG. 8, slide portion 22 pressed from operation portion 33A is slid toward the left side and presses pressing portion 23A in a leftward direction.

Then, after the side face of pressing portion 23A, which has a curved shape, located on the upper left side is brought into contact with inclined face portion 21B that becomes an inner wall of cover 21, pressing portion 23A is further pressed in a leftward direction so as to slide its upper left side face, which has a curved shape, along the inclined face to the lower side of the inclination. Accordingly, the left side face of pressing portion 23A is slid in a downward direction.

Accordingly, the lower face of pressing portion 23A presses base sheet 25 with a pressing force corresponding to the slide operation force of operating portion 33A. Therefore, sheet resistive body 28A is bent in the downward direction so as to be brought into contact with conductive plate 30 for being electrically connected thereto.

Thereafter, when the slide operation force is applied further to operation portion 33A, the contact area between sheet resistive body 28A and conductive plate 30 of sheet resistive body 28A increases depending on the pressing force of sheet resistive body 28A due to formation of delicate asperities on the lower face of high resistive body layer 282A of sheet resistive body 28A. Accordingly, a resistance value between sheet resistive body 28A and conductive plate 30 decreases.

In other words, a voltage input to control unit 43 is low when the slide operation force is weak. As the slide operation force is increased, the voltage input to control unit 43 increases.

Thereafter, when operation portion 33A is further pressed, the slide operation force is increased again. Simultaneously, as described above, the resistance value between sheet resistive body 28A and conductive plate 30 is decreased, and the voltage further increases, which is detected by control unit 43.

In addition, when the slide operation force is released for operation portion 33A, operation portion 33A returns to the neutral position in accordance with the elastic recovery force that is stored in rim portion 23B of pressing unit 23. Accordingly, pressing portion 23A does not press sheet resistive body 28A, whereby the resistance value between sheet resistive body 28A and conductive plate 30 is increased. By detecting the increase in the resistance value, the control unit 43 detects the return of operation portion 33A to the neutral position.

In addition, even when the slide operation of operation portion 33A is performed in the front-to-rear direction or in the rightward direction, similarly, front and rear or right sheet resistive bodies 28B to 28D are pressed by pressing portion 23A located on the upper side thereof, and sheet resistive bodies 28B to 28D are brought into contact with conductive plate 30. Accordingly, a change in the voltage according to the slide operation force is detected by control unit 43.

In addition, even when slide operation of operation portion 33A is performed in a direction other than the directions toward the front, rear, right, and left sides, the ratios of the pressing forces for sheet resistive bodies 28A to 28D in four directions of the directions toward front, rear, right, and left sides change in accordance with the direction in which the slide operation is performed. Accordingly, control unit 43 can detect the direction in which the slide operation is performed based on differences between resistance values of sheet resistive bodies 28A to 28D and conductive plate 30.

In addition, when operation portion 33A is pressed by a finger in the state in which operation portion 33A is in the neutral position, movable contact point 36 is elastically inverted with the sense of clicking, and movable contact point 36 is brought into contact with fixed contact point 40A and fixed contact point 40B of fixed contact point pair 40. Accordingly, fixed contact point 40A and fixed contact point 40B are electrically connected to each other.

In addition, when the finger is detached from operation portion 33A or the applied force is released, the elastic inversion of movable contact point 36 is returned to its original state, and movable contact point 36 is departed from fixed contact point 40A and fixed contact point 40B. Accordingly, the electrical connection between fixed contact point 40A and fixed contact point 40B is released.

In addition, when any of four places located on the front, rear, left and right sides of auxiliary button 32 is pressed by a finger or released from the finger, similarly to when operation portion 33A is operated, movable contact point 36 is brought into contact with or departed from fixed contact point pair 40. Accordingly, control unit 43 can detect the side of auxiliary button 32 that is pressed.

Then, control unit 43 detects a change in the voltage according to the slide operation of operation portion 33A or electrical connection and disconnection between fixed contact point 40A and fixed contact point 40B according to the pressing operation, and control unit 43 controls display of display means 51.

Figure 9A:
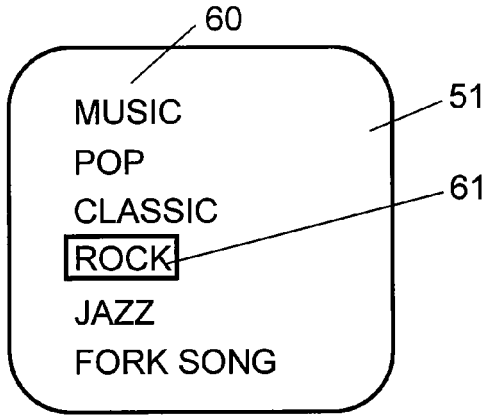
FIGS. 9A and 9B are diagrams of screens of an electronic device using the pressure sensitive switch according to Embodiment 1 of the invention.
Figure 9B:
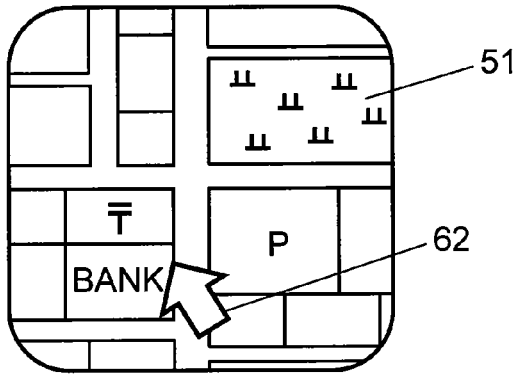
Figure 10:
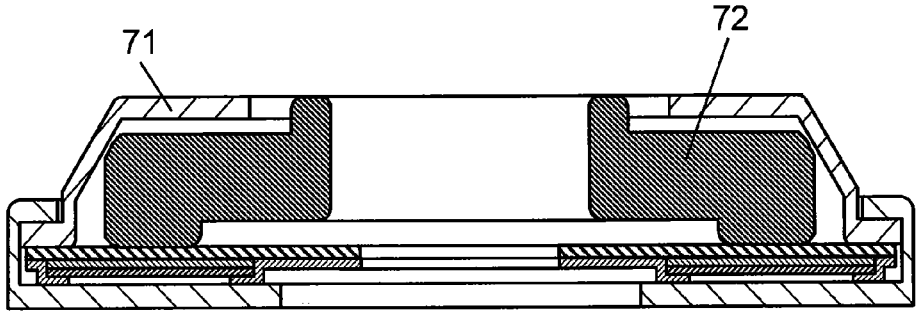
FIG. 10 is a cross-sectional view of another pressure sensitive switch according to Embodiment 1 of the invention.

A concrete example of controlling the display means is shown in FIGS. 9A and 9B. For example, as represented in a diagram of a screen shown in FIG. 9A, a plurality of menus 60 for selecting music is displayed in display means 51 such as a liquid crystal display device. In this state, when a leftward slide operation is performed for operation portion 33A, control unit 43 detects changes in the contact resistance values between sheet resistive bodies 28A to 28D in the leftward direction and conductive plate 30, and control unit 43 upwardly moves cursor 61 displayed in display means 51 by one line.

In addition, when the slide operation is continuously performed with a force of some degree, control unit 43 detects changes in the contact resistance values between sheet resistance bodies 28A to 28D and conductive plate 30, and control unit 43 continuously moves cursor 61 in the leftward direction. When, operation portion 33A is strongly operated further, and the contact resistance values change markedly, control unit 43 raises the movement speed of cursor 61.

On the other hand, as shown in FIG. 9B, a menu of a map is displayed in display means 51. In this state, when a leftward slide operation is performed once for operation portion 33A, control unit 43 moves pointer 62 in the leftward direction by one. In addition, when the leftward slide operation is performed consecutively, control unit 43 continuously moves pointer 62 in the leftward direction. When the slide operation is performed with a stronger force, control unit 43 raises the movement speed of pointer 62.

Then, as described above, in the state in which cursor 61 or pointer 62 is moved in the upward, downward, leftward, or rightward direction so as to be placed on a menu or a map that is desired to be selected, when a pressing operation is performed for operation portion 33A in the state in which operation portion 33A is returned to its neutral position by releasing the force of the slide operation applied to operation portion 33A or is naturally returned to the neutral position, the electrical connection between fixed contact point 40A and fixed contact point 40B is detected by control unit 43. Accordingly, the screen is completely switched to a screen on which a plurality of song titles are displayed, a screen on which an enlarged map of the selected place is displayed, or the like.

In other words, the amount of movement or the speed of cursor 61 or pointer 62 is changed or switching between screens can be performed, in accordance with a slide operation or a pressing operation that is performed with the finger not being departed from operation portion 33A. Accordingly, while watching display means 51, an operator can perform an operation without his or her eyes being off operation portion 33A. Therefore, a smooth operation can be performed.

In addition, in order to move cursor 61 or pointer 62 to the front, rear, left or right side, cursor 61 or pointer 62 can be also moved by pressing the position located on the front, rear, left, or right side of the auxiliary button 32.

As described above, according to this embodiment, slide portion 22 is stored in cover 21 so as to be slidable within a horizontal plane. By sliding slide portion 22, pressing portion 23A pressed by slide portion 22 presses sheet resistive bodies 28A to 28D that are disposed at least four places. At this time, resistance values between sheet resistive bodies 28A to 28D and conductive plate 30 change in accordance with a change in the force of the slide operation for sliding slide portion 22. By forming pressure sensitive switch 31 as described above, an operation for moving cursor 61 or pointer 62 in various directions or an operation for determining selected menu 60 can be performed without releasing the finger that has operated operation portion 33A. Accordingly, a pressure sensitive switch capable of performing various operations under a simple configuration can be acquired.

In addition, by forming a hole perforated from cover 21 to conductive plate 30, slide portion 22 can be operated while being held by movable portion 34A of pressure rubber 34 inserted into the hole, and movable contact point 36, fixed contact point pair 40, or the like is disposed on the lower side of auxiliary button 32, whereby a pressure sensitive switch capable of performing various operations such as the operation for determining menu 60 can be acquired.

In the description presented above, a configuration in which sheet resistive bodies 28A to 28D are formed by overlapping low resistive body layers 281A to 281D and high resistive body layers 282A to 282D on the lower face of base sheet 25 has been described. However, the present invention can be applied to a configuration in which a pressure sensitive conduction layer acquired by dispersing conductive particles such as carbon inside a base material such as silicon rubber is used.

In the description presented above, pressing unit 23 includes pressing portions 23A in four places located on the front, rear, left, and right sides, and sheet resistive bodies 28A to 28D located on four places are pressed. However, the present invention can be performed by using a configuration in which the pressing unit includes a pressing portion in two places located on the front and rear sides or the left and right sides, and sheet resistive bodies located on the front and rear sides or the left and right sides are pressed.

In the description presented above, slide portion 22 and pressing unit 23 are configured as separated bodies. However, as shown in the cross-sectional view of FIG. 10 or in the exploded perspective view of FIG. 11, slide portion 22 and pressing unit 23 may be integrally formed so as to be configured as slide pressing unit 72, which has an approximately circular shape in the top view, stored in cover 71. In such a case, the pressing switch can be assembled in a simple manner.

In addition, by fixing a predetermined place of rim portion 72A, which has elasticity, included on the left and right sides of slide pressing unit 72 to cover 71, slide pressing unit 72 can be returned to the center position when the slide operation force is released.

In the description presented above, pressing portion 23A is brought into contact with inclined face portion 21B, which becomes an inclined face on the inner wall of cover 21, so as to be slid in the downward direction. However, the present invention is not limited thereto. As shown in the cross-sectional view of FIG. 12, the present invention can be applied to a configuration in which a contact portion between slide portion 73 and pressing portion 74A is also configured as an inclined face.

In addition, in the description presented above, pressing unit 23 is configured by pressing portions 23A disposed on the front, rear, left, and right sides and slightly thin rim portion 23B binding pressing portions 23A. However, as shown in the perspective view of FIG. 13, pressing unit 75 of a uniform donut shape that has an approximately oval cross-sectional shape may be configured.

In addition, in such a case, instead of sheet resistive bodies 28A to 28D disposed in four places located on the front, rear, left, and right sides, a configuration in which sheet resistive bodies 76A to 76H may be disposed in eight places located on the front, rear, left, and right sides and at the centers therebetween or sheet resistive bodies are disposed on 12 places or 16 places that are divided into multiple times of four. Accordingly, the angular resolution capability of the slide portion for the slide direction is improved. Therefore, display of cursor 61 or pointer 62 more accurately matching the operator's operation can be achieved.

Embodiment 2

Hereinafter, Embodiment 2 of the present invention will be described. To each portion having the same configuration as that of Embodiment 1, a same reference sign is assigned, and the description thereof is omitted here.

Figure 14:
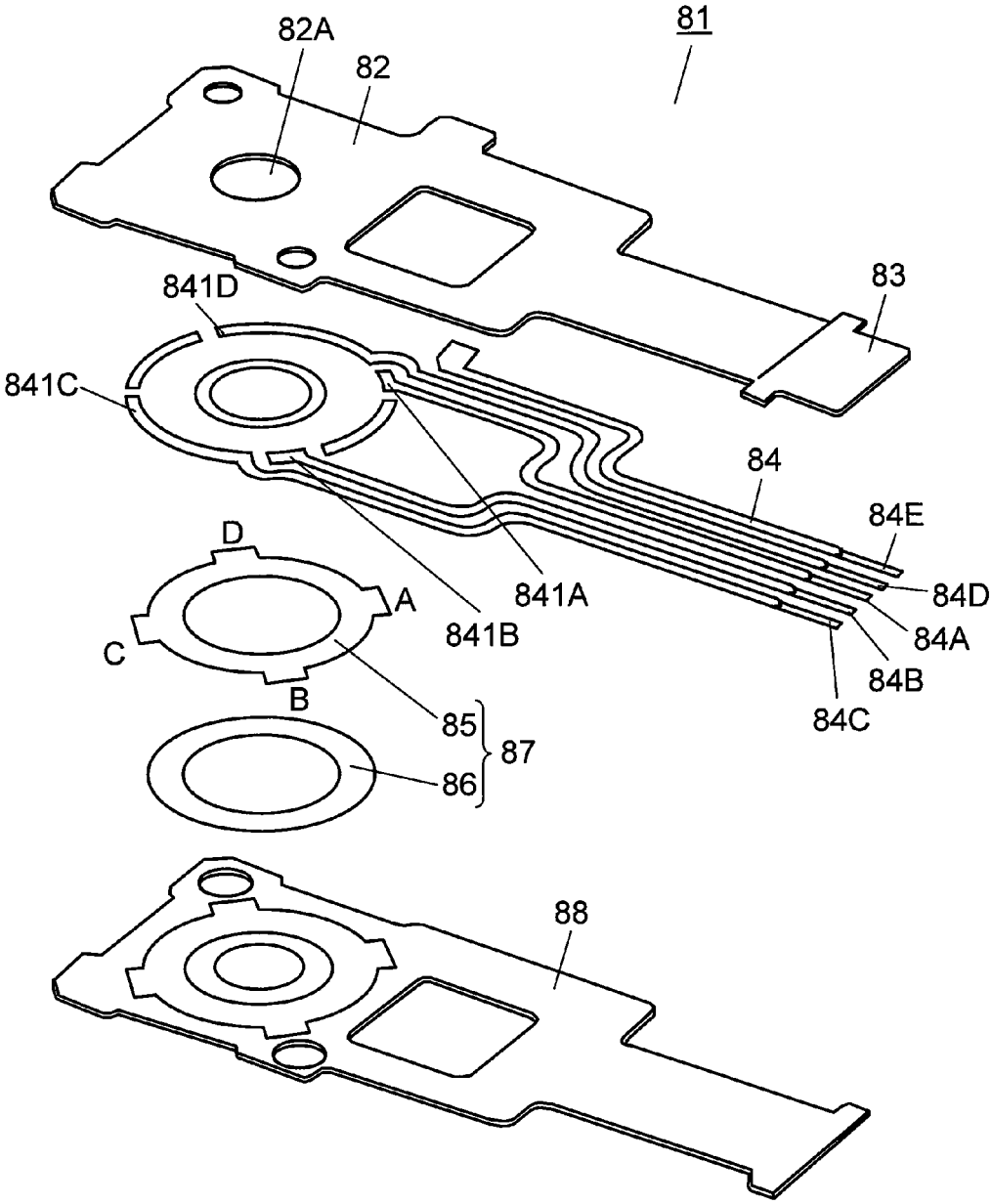
FIG. 14 is an exploded perspective view of a pressure sensitive conduction unit according to Embodiment 2 of the present invention.

FIG. 14 is an exploded perspective view of pressure sensitive conduction unit 81 according to Embodiment 2. Base sheet 82 having a film shape has flexibility and is formed to have one end positioned on the right side to extend. Base sheet 82 is formed of polyethyleneterephthalate, polycarbonate, polyimide, or the like. Base sheet 82 includes circular hole 82A disposed in an approximate center position of the left half face and connector cover 83, which is formed of insulating resin, on the extended right end of the base sheet.

In addition, on the lower face of base sheet 82, a plurality of lines 84 are disposed. The lines 84 are formed by printing a conductive material such as silver paste or processing conductive metal by using an etching process, a press process, or the like. The right end portions of the lines 84A to 84E are attached to the lower face of connector cover 83 so as to form connector terminals 84A to 84E.

In addition, connection terminals 841A to 841D, which are located on the left end of lines 84 connected to connector terminals 84A to 84D are connected to low resistive body layer 85, which has a ring shape, printed so as to be formed on the lower face of base sheet 82.

This low resistive body layer 85 is a resistive body having a sheet resistance value of 0.5 kΩ/μm to 30 kΩ/μm which is acquired by dispersing carbon powders inside synthetic resin and is connected to connection terminals 841A to 841D in points A to D.

On the lower face of low resistive body layer 85, high resistive body layer 86, which has a sheet resistance value of 50 kΩ/μm to 5 MΩ/μm, having a ring shape is printed so as to be formed in an overlapping manner. Sheet resistive body 87 is configured by low resistive body layer 85 and high resistive body layer 86.

In addition, insulating layer 88 is attached to the lower face of base sheet 82 so as to expose the lower face of high resistive body layer 86, whereby configuring pressure sensitive conduction unit 81.

Figure 15:
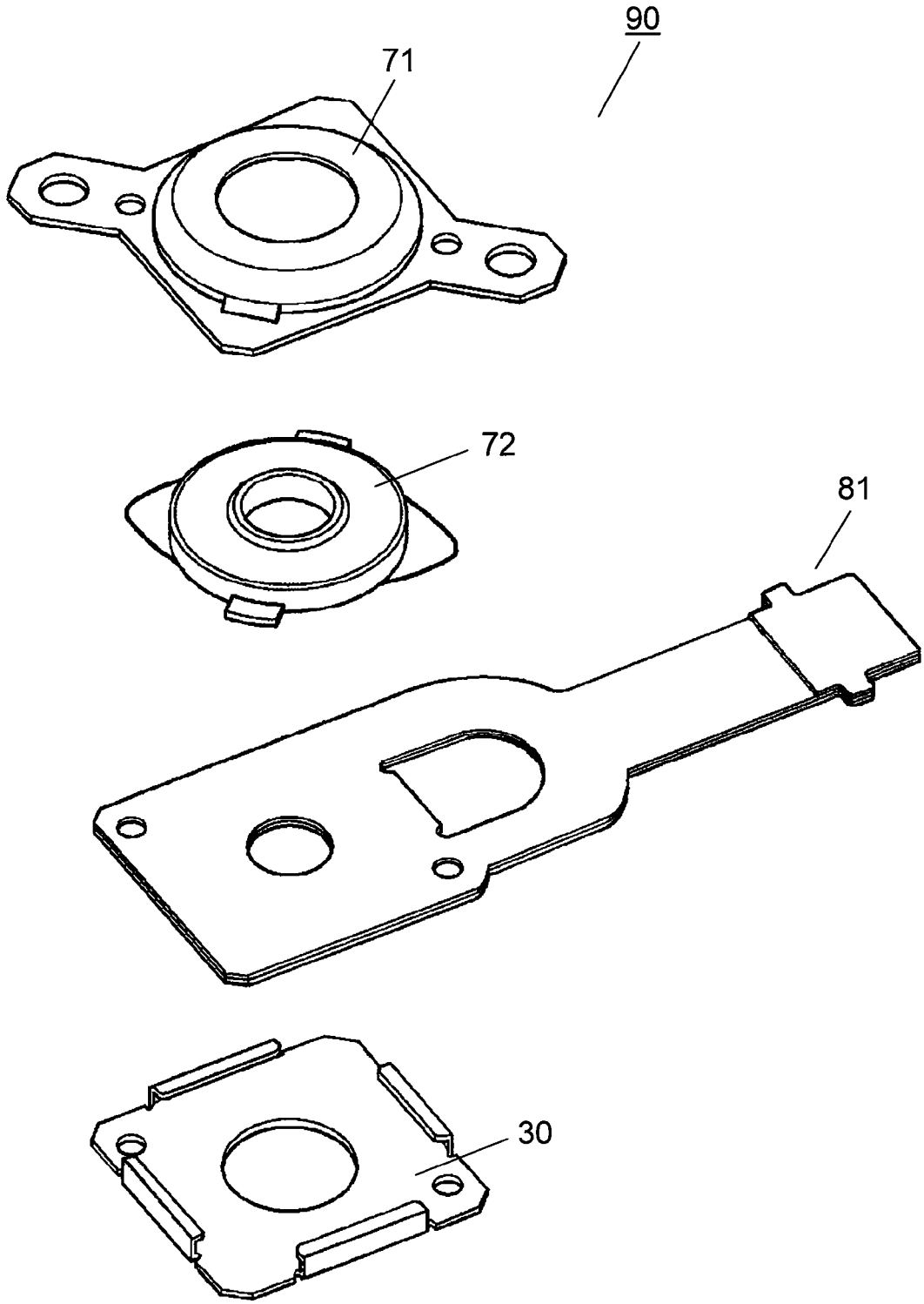
FIG. 15 is an exploded perspective view of a pressure sensitive switch according to Embodiment 2 of the present invention.

In addition, this pressure sensitive conduction unit 81, as shown in the exploded perspective view of the pressure sensitive switch of FIG. 15, configures pressure sensitive switch 90 together with cover 71, slide pressing unit 72, and conductive plate 30.

Figure 11:
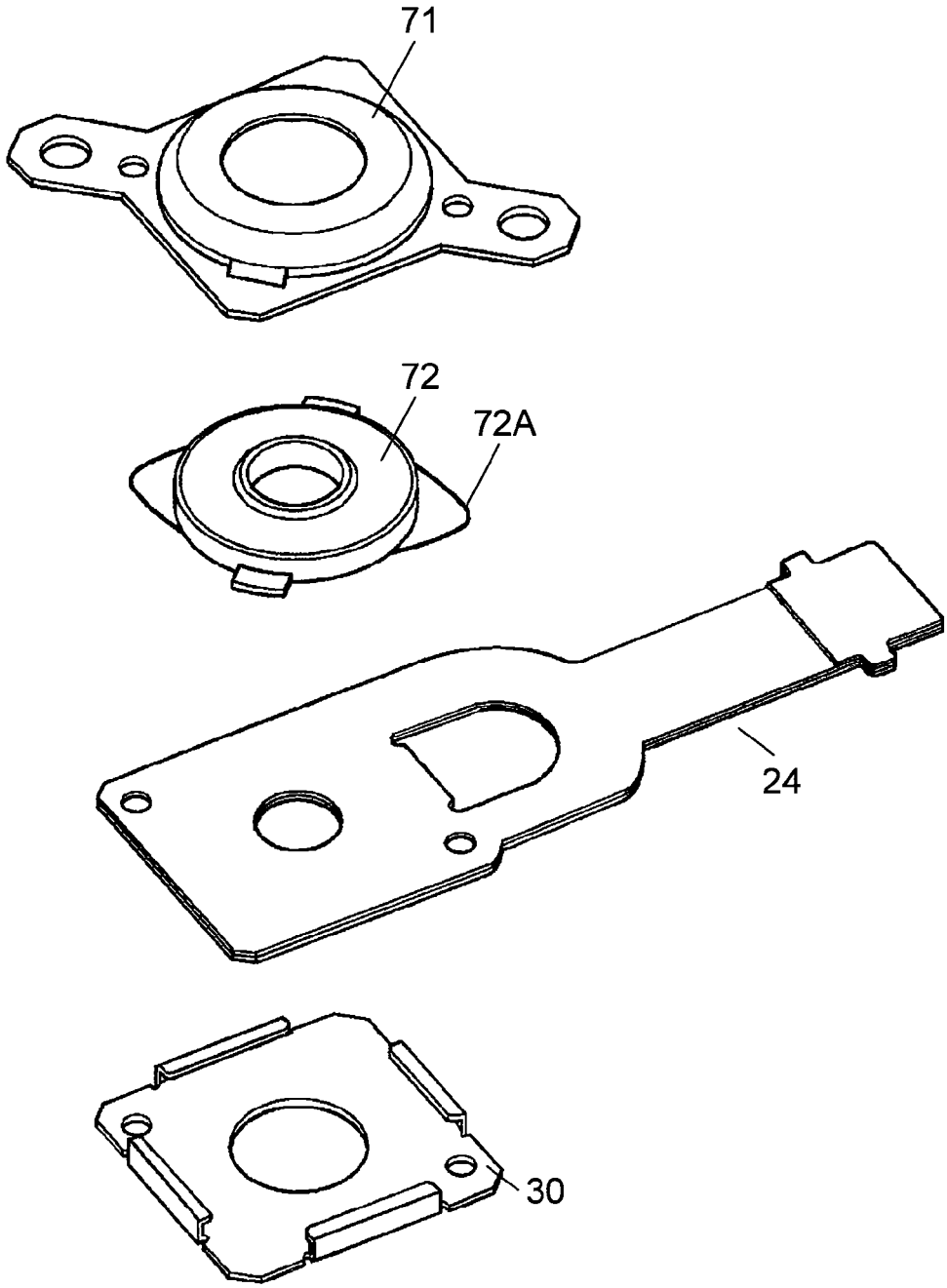
FIG. 11 is an exploded perspective view of further another pressure sensitive switch according to Embodiment 1 of the invention.
Figure 12:
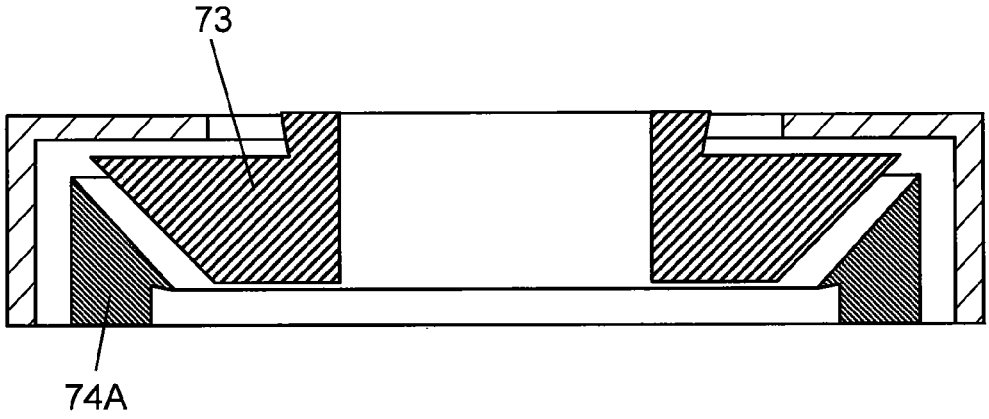
FIG. 12 is a cross-sectional view of still another pressure sensitive switch according to Embodiment 1 of the invention.
Figure 13:
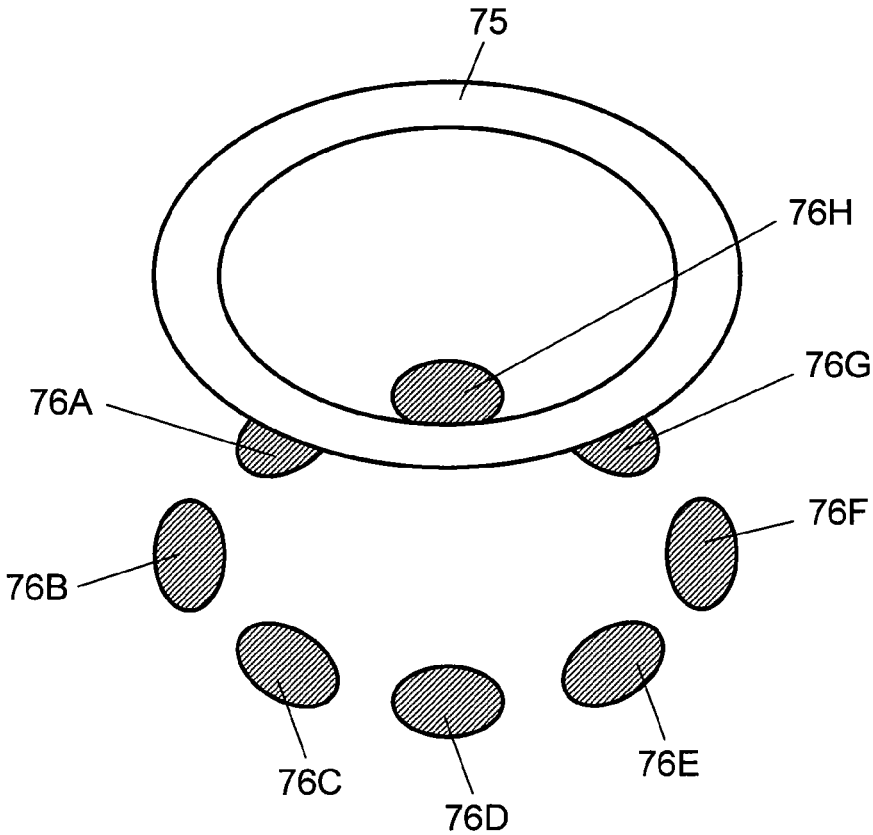
FIG. 13 is a perspective view of a pressing unit and a sheet resistive body of another pressure sensitive switch according to Embodiment 1 of the invention.

The overall configuration of pressure sensitive switch 90 is the same as that of Embodiment 1 described with reference to FIG. 11. There is only a difference in that pressure sensitive conduction unit 24 becomes pressure conductive unit 81.

Figure 16:
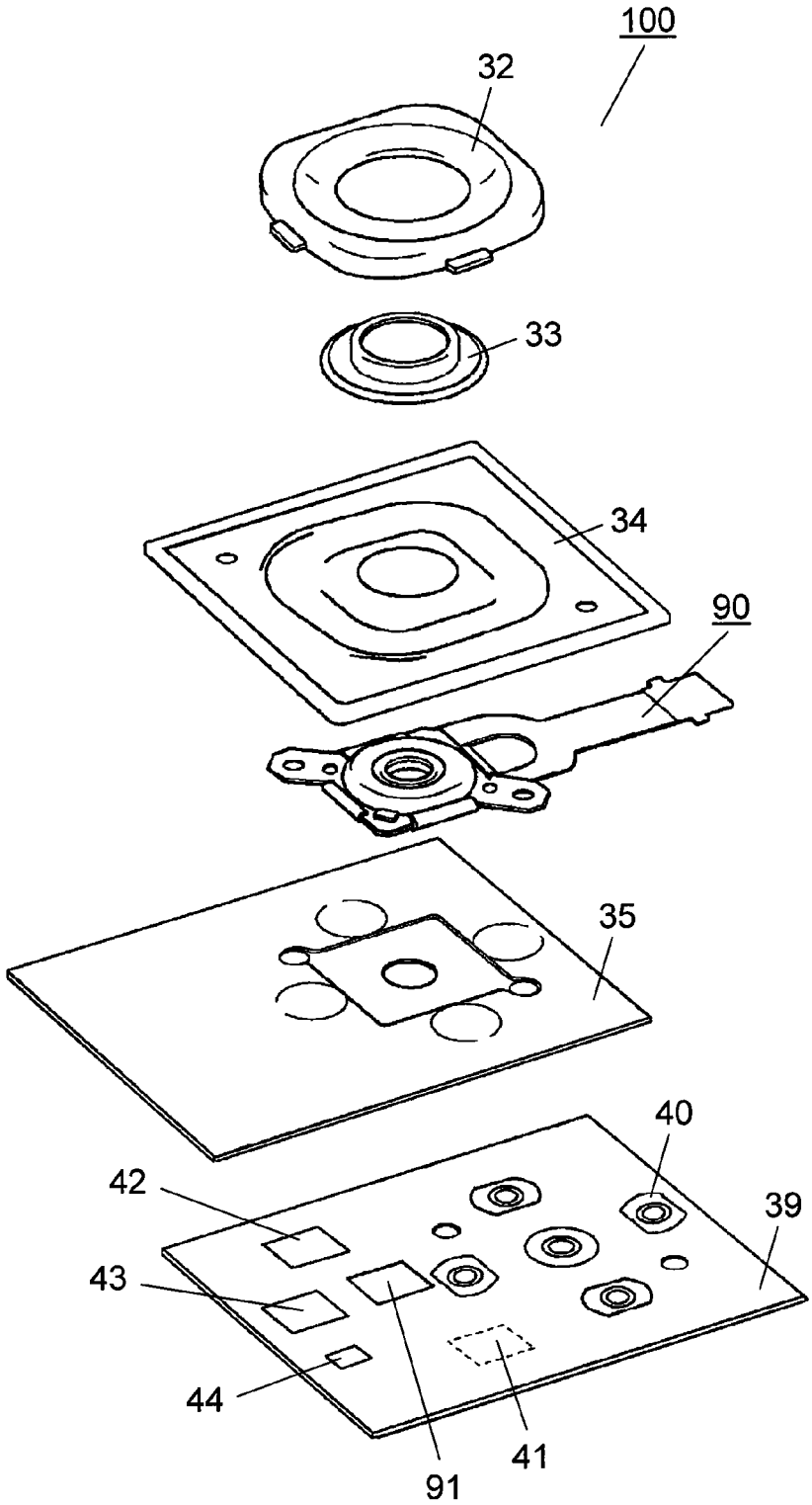
FIG. 16 is an exploded perspective view of an input device according to Embodiment 2 of the present invention.

Pressure sensitive switch 90 is built in an electronic device such as a cellular phone so as to configure input device 100 as shown in the exploded perspective view of FIG. 16. In input device 100, similarly to the configuration of the input device according to Embodiment 1, auxiliary button 32, operation body 33, and pressure button rubber 34 are placed on the upper face of pressure sensitive switch 90.

In addition, similarly to the input device according to Embodiment 1, pressure sensitive switch 90 is placed on movable contact point body sheet 35. Likewise, on the upper face of substrate 39, a plurality of fixed contact point pairs 40, connection connector 41, constant voltage power supply 42, control unit 43, and resistor 44 are disposed.

However, Embodiment 2 is different from Embodiment 1 in that switch unit 91 configured by a semiconductor device or the like and connected to control unit 43 is disposed on the upper face of substrate 39.

Figure 17:
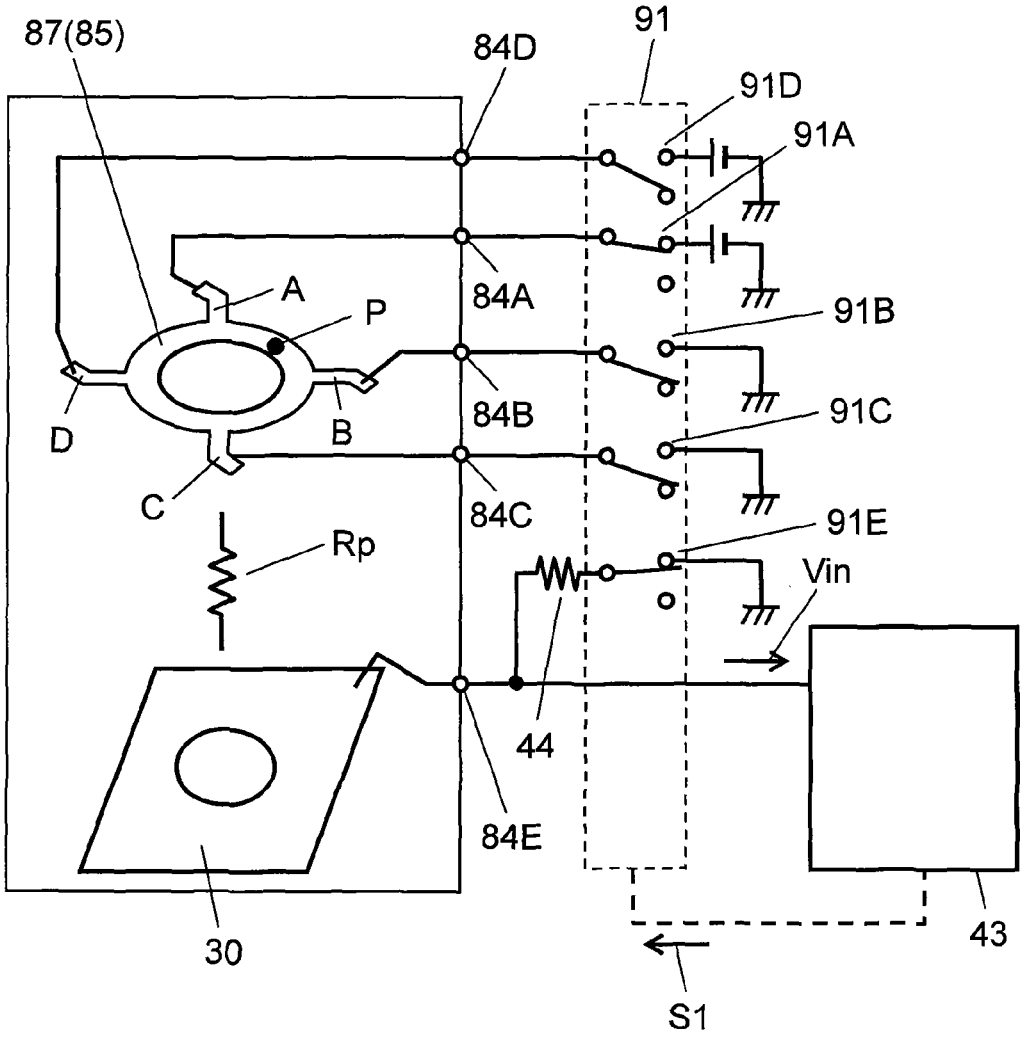
FIG. 17 is a circuit diagram of the input device according to Embodiment 2 of the invention.

Next, the electrical configuration of input device 100 will be described with reference to the circuit diagram of FIG. 17. As shown in FIG. 17, connector terminals 84A to 84D (first to fourth terminals) connected to different places point A to point D of low resistive body layer 85 of sheet resistive body 87 are connected to switches 91A to 91D (first to fourth switches) of switch unit 91. In this embodiment, points A to D are arranged in ring-shaped sheet resistive body 87 at intervals of 90 degrees.

Here, connector terminals 84A and 84D are connected to a constant voltage power supply (for example, +5 V), and connector terminals 84B and 84C are connected to the ground electric potential (0 V). Switches 91A and 91D switch between the connection states and the open states of connector terminals 84A and 84D and the constant voltage power supply (for example, +5 V), and switches 91B and 91C switch between the connection states and the open states of connector terminals 84B and 84C and the ground electric potential (0 V). Switch unit 91 can independently switch between connection states and the open states of switches 91A to 91D. As the initial state of the switches, switch 91A is in the state of being connected to the constant voltage power supply, and switches 91B to 91D are in the open state.

The voltage value of the constant voltage power supply may be equal to or higher than 0.1 V and equal to or lower than 30 V. More preferably, the voltage value is equal to or higher than 1 V and equal to or lower than 15 V.

One end of conductive plate 30 that is branched through connector terminal 84E (fifth terminal) is connected to control unit 43, and a voltage signal denoted by Vin is input to control unit 43. On the other hand, the other end is connected to switch 91E (fifth switch) through resistor 44, and switch 91E is in the state of being connected to the ground electric potential in the initial state.

In addition, switching of switches 91A to 91E is performed in accordance with an output signal 51 output from control unit 43. Voltage signal Vin is changed in accordance with the result of switching of switches 91A to 91E.

In input device 100 configured as described above, for example, when point P of sheet resistive body 87 is pressed to slide pressing unit 72 as a result of operator's performing a slide operation for operation portion 33A, the contact area between sheet resistive body 87 and conductive plate 30 is changed, and contact resistance, which is denoted by Rp, between sheet resistive body 87 and conductive plate 30 changes.

Then, control unit 43 performs an estimation process of the pressing force at point P corresponding to the slide operation force applied to operation portion 33A. The constant voltage power supply is applied from switch 91A, and switch 91E is connected to the ground electric potential. Accordingly, voltage signal Vin is determined as a divided voltage ratio between (Rp+Rap) that is a sum of contact resistance Rp between sheet resistive body 87 and conductive plate 30 and line resistance Rap between point A to point P and resistance value R of resistor 44.

Then, control unit 43 estimates the pressing direction at point P corresponding to the slide operation force applied to operation portion 33A through the first to third direction estimation processes to be described later and then performs a correction process of correcting line resistance Rap between point A to point P. Accordingly, contact resistance Rp between sheet resistive body 87 and conductive plate 30 is calculated.

Next, the first to third direction estimation processes will be sequentially described.

Control unit 43 estimates the pressing direction at point P in accordance with the first to third direction estimation processes. First, the first direction estimation process will be described. As shown in the circuit diagram of FIG. 18, control unit 43 switches switch 91A from the open state to the state of being connected to the constant voltage power supply, switches switch 91C from the open state to the state of being connected to the ground electric potential, and switches switch 91E to the open state by using control signal 51.

Figure 18:
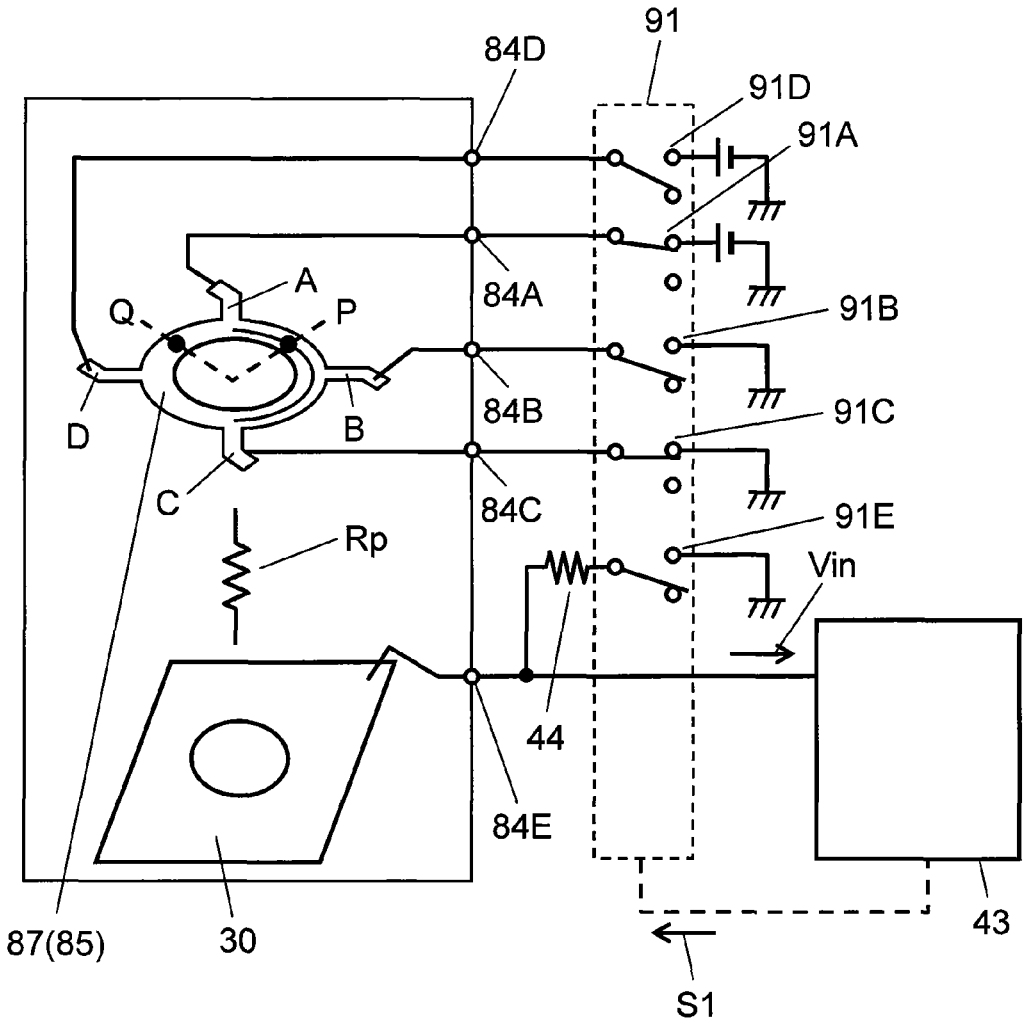
FIG. 18 is a circuit diagram illustrating the operation of the input device according to Embodiment 2 of the invention.

Accordingly, a voltage corresponding to the divided voltage ratio at point P in the path of point A- point P- point C shown in FIG. 18 is input to control unit 43 as input voltage Vin through contact resistance Rp between sheet resistive body 87 and conductive plate 30.

Then, control unit 43 estimates the pressing direction, for example, based on a comparison table of voltage signal Vin and the pressing direction, which is disposed in control unit 43. Here, since the sheet resistive body 87 has a ring shape, it is estimated that the sliding direction of operation portion 33A is the direction of a virtual pressing point of point Q or point P at which voltage signal Vin has the same value.

Next, the second direction estimation process will be described. As shown in the circuit diagram of FIG. 19, control unit 43 switches switch 91A to the open state, switches switch 91B to the ground electric potential, switches switch 91C to the open state, and switches switch 91D to state of being connected to the constant voltage power supply.

Figure 19:
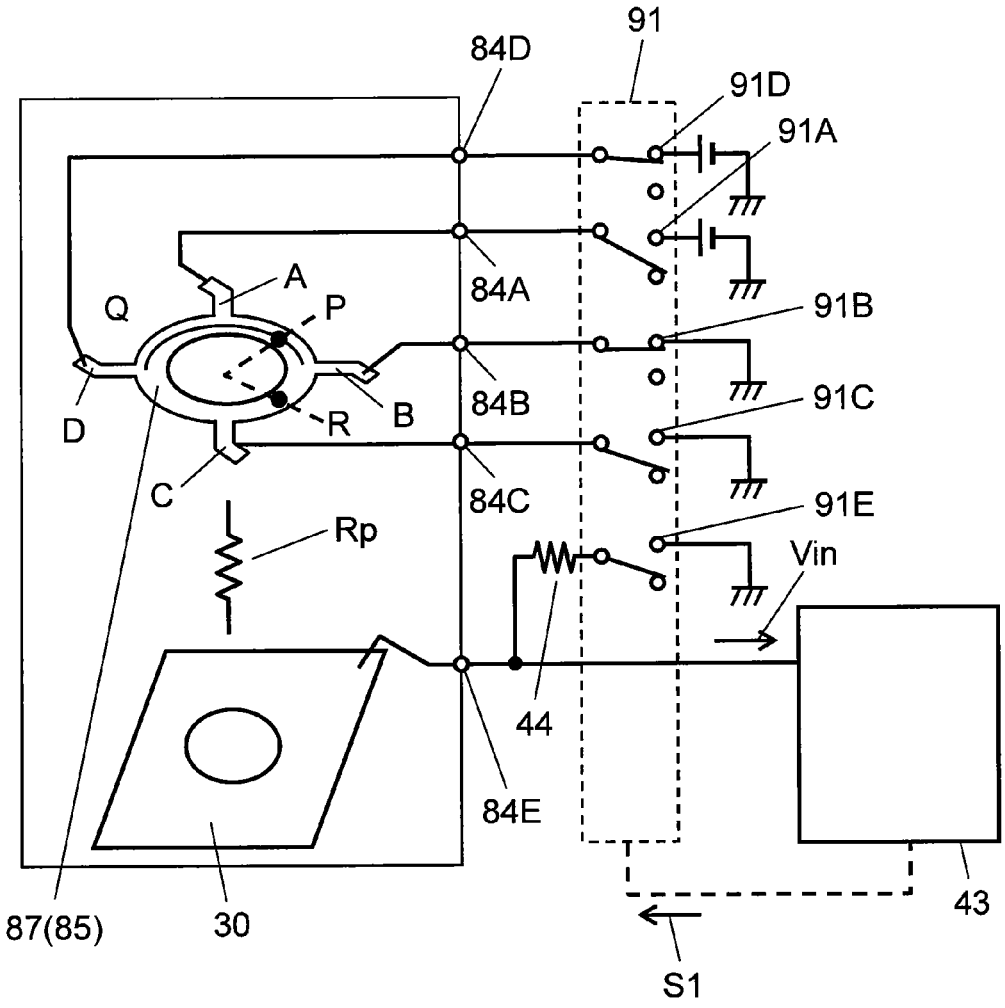
FIG. 19 is a circuit diagram illustrating the operation of the input device according to Embodiment 2 of the invention.
Figure 20:
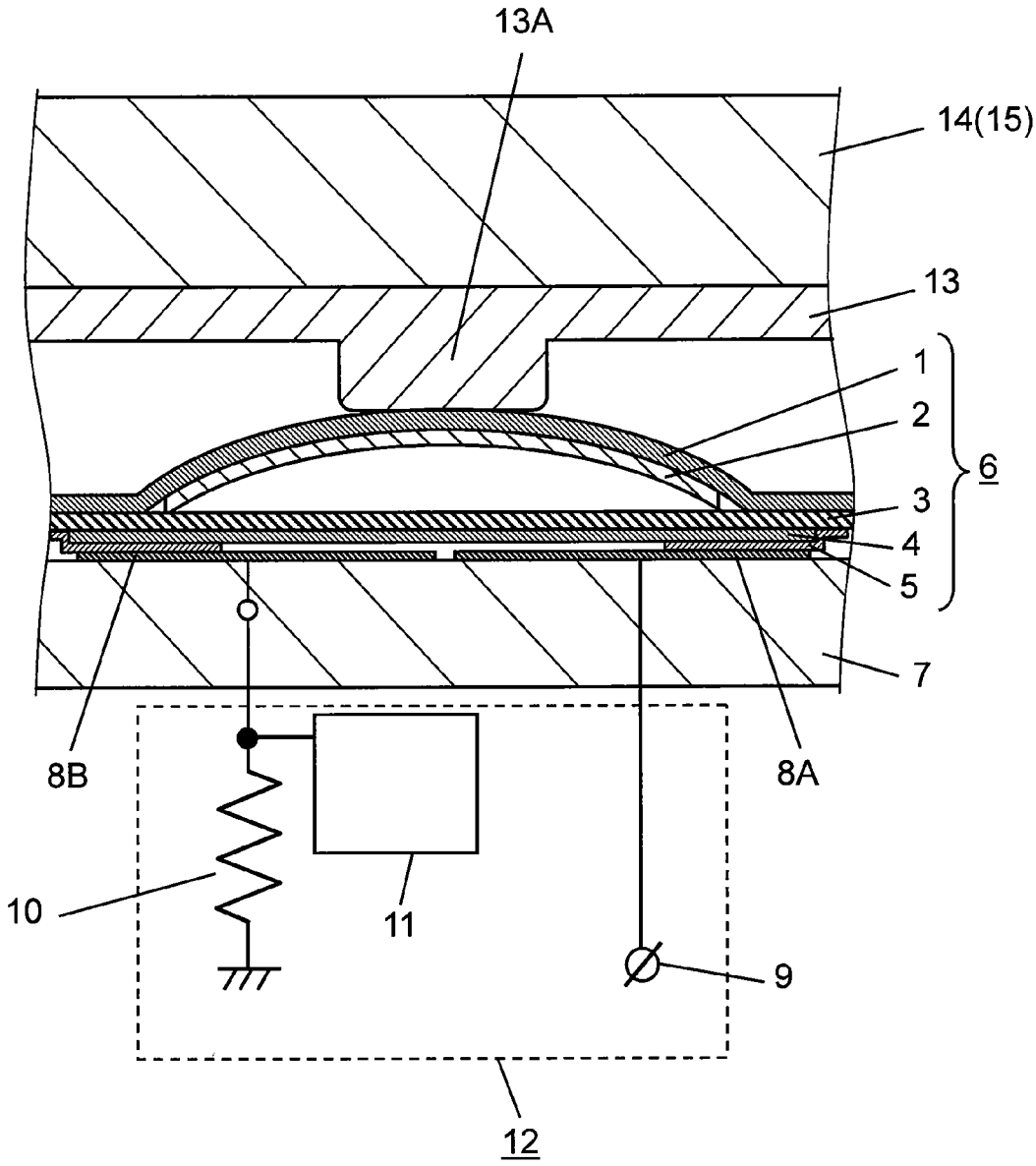
FIG. 20(PRIOR ART)
FIG. 20 is a cross-sectional view of a conventional pressure sensitive switch.
Figure 21:
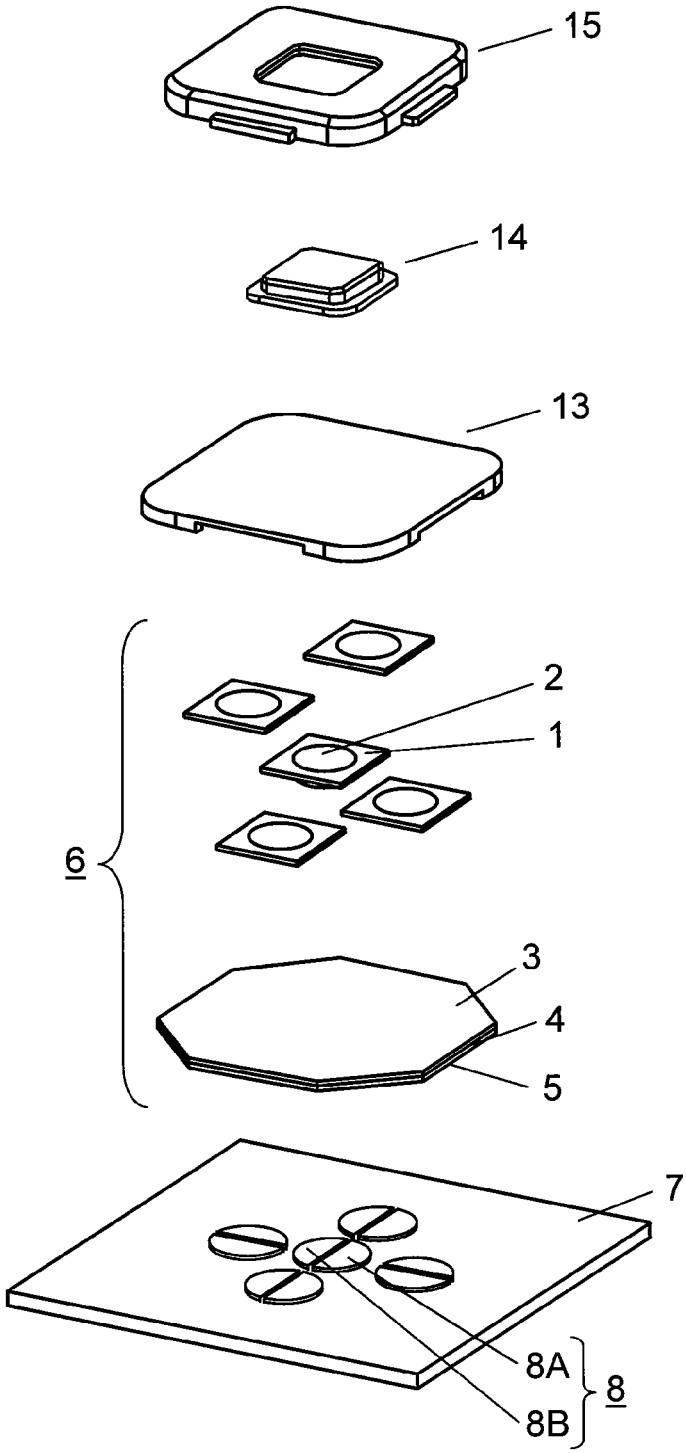
FIG. 21(PRIOR ART)
FIG. 21 is an exploded perspective view of the conventional pressure sensitive switch.
Figure 22:
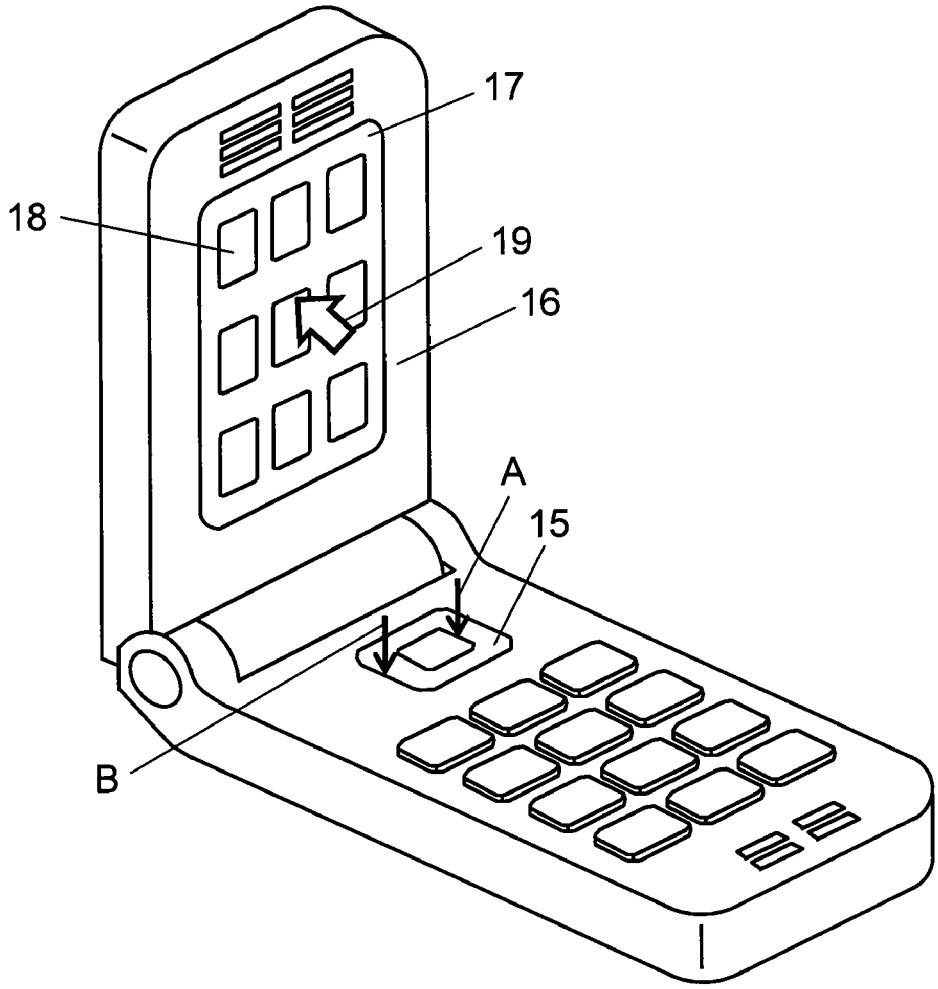
FIG. 22(PRIOR ART)
FIG. 22 is a perspective view of an electronic device using a conventional pressure sensitive switch.

Accordingly, a voltage corresponding to the divided voltage ratio at point P in the path of point D- point P- point B shown in FIG. 19 is input to control unit 43 as input voltage Vin through contact resistance Rp between sheet resistive body 87 and conductive plate 30.

Then, control unit 43 estimates the sliding direction of operation portion 33A to be the direction of point P or virtual pressing point R as the pressing direction, for example, based on a comparison table of voltage signal Vin and the pressing direction, which is disposed in control unit 43.

Next, the third direction estimation process will be described. Control unit 43 estimates the sliding direction of operation portion 33A to be the direction of point P by comparing the result of the first direction estimation process and the result of the second direction estimation process to each other.

In other words, by applying a voltage to a resistive body layer having specific sheet resistance, a different voltage is input to control unit 43 in accordance with the pressing direction. Accordingly, control unit 43 can estimate the pressing direction, that is, the direction of the slide operation of operation portion 33A.

Even when there are a plurality of paths incurring a specific electric potential difference as for the case of ring-shaped sheet resistive body 87, by performing the third direction estimation process of comparing the result of the first direction estimation process and the result of the second direction estimation process, in which the applied positions of the voltage are changed, to each other and comparing the estimation results of the pressing direction, the direction of the slide operation can be accurately determined.

In other words, control unit 43 measures a plurality of input voltages Vin by switching switches 91A to 91D of switch unit 91 and estimates the pressing direction of sheet resistive body 87 based on input voltages Vin.

Subsequently, a correction process of line resistance Rap will be described in detail. First, control unit 43 estimates a resistance value of (Rp+Rap), for example, based on a comparison table of voltage signal Vin and (Rp+Rap), which is disposed inside control unit 43.

After control unit 43 estimates the pressing direction at this point P, for example, in a case where line resistance between point A and point C is Rac that is a known value and the angle corresponding to an arc therebetween is a degrees and the angle corresponding to the estimated pressing direction at point P is β degrees, control unit 43 calculates "Rac×β/α" as line resistance Rap between point A and point P.

Then, control unit 43 calculates contact resistance Rp by subtracting line resistance Rap between point A and point P from (Rp+Rap) and estimates the pressing force at point P, that is, the slide operation force of operation portion 33A, for example, based on the comparison table of contact resistance Rp and the pressing force, which is disposed inside control unit 43.

Based on the above-described estimation method, the control unit, for example, as shown in FIG. 9B described in Embodiment 1, in the state in which the menu of a map is displayed in display means 51, when a leftward slide operation is performed for operation portion 33A once, control unit 43 moves pointer 62 in the leftward direction by one. When the leftward slide operation is performed consecutively, control unit 43 continuously moves pointer 62 in the leftward direction. In addition, when the leftward slide operation is performed with a stronger force, control unit 43 raises the movement speed of pointer 62.

Even when a slide operation is performed for operation portion 33A in a tilted direction slightly deviated from the leftward direction, control unit 43 detects the sliding direction and accurately moves pointer 62 in the operation direction.

When the slide operation force for operation portion 33A is released, operation portion 33A is returned to the neutral position, which is the same as that described in Embodiment 1.

In other words, similarly to Embodiment 1, the operator can perform various slide operations or a press operation with his or her finger not departed from operation portion 33A. In accordance with the operation, the amount of movement or the speed of cursor 61 or pointer 62 can be changed or switching between screens can be performed. Accordingly, the operator can perform an operation while watching display means 51 without moving his or her eyes to operation portion 33A. Therefore, an operation can be smoothly performed.

In addition, in the description presented above, the shape of sheet resistive body 87 is a ring shape. However, the present invention is not limited thereto. Thus, a resistive body layer having a line shape can be disposed in an arc shape or a spiral shape.

In such a case, comparison between the result of the first direction estimation process and the result of the second direction estimation process, in which the applied position of the voltage is changed, do not need to be performed. In other words, by connecting both ends of the line-shaped resistive body layer to different electric potential, a desired voltage distribution can be formed within the resistive body layer. Accordingly, the sliding direction can be accurately estimated based on only the result of the first direction estimation process.

In addition, in the description presented above, when performing an estimation process of the slide operation force based on the pressing force at point P, control unit 43 performs the correction process. However, the present invention is not limited thereto. For example, in a case where input device 100 is configured by connecting a plurality of points of point A to point D of sheet resistive body 87 to the constant voltage power supply, an estimation error of the pressing force at point P due to line resistance between the point connected to the constant voltage power supply and pressed point P decreases. Accordingly, control unit 43 can estimate the slide operation force almost accurately without performing the correction process.

In addition, in such a case, when all the four places of point A to point D are connected to the constant voltage power supply, the estimation error of the pressing force at point P due to line resistance between the point connected to the constant voltage power supply and point P becomes a minimum. Accordingly, control unit 43 can estimate the slide operation force with high accuracy.

In addition, in the description presented above, the pressure sensitive switch is configured by slide pressing unit 72. However, the present invention is not limited thereto. Thus, slide pressing unit 72 may be configured by the slide portion and the pressing unit that are described in Embodiment 1.

As described above, according to this embodiment, the sheet resistive body is formed in the shape of a ring, an arc, or a spiral. Accordingly, the sheet resistive body can be disposed in a predetermined angle range such as a direction of 360 degrees that becomes the entire horizontal plane. Therefore, a pressure sensitive switch that has high flexibility in the sliding direction and can perform various operations in a simple manner can be acquired.

In addition, the pressure sensitive switch, the switch unit connected to the pressure sensitive switch, the control unit connected to the pressure sensitive switch and the switch unit, and the constant voltage power supply of a predetermined voltage are included. The terminal of the pressure sensitive switch that is connected to the sheet resistive body is connected to the constant voltage power supply, and the terminal of the power sensitive switch that is connected to the conductive plate is connected to the control unit. The control unit estimates the pressing direction in which the sheet resistive body is pressed based on the input voltage input to the control unit through the conductive plate of the pressure sensitive switch. Since a specific voltage distribution changing in accordance with a change in the operator's pressing direction is formed in the sheet resistive body, for example, the operation direction in which the operator performs the slide operation can be detected with high accuracy. Accordingly, an input device capable of performing various operations can be acquired.

A pressure sensitive switch according to the present invention and the input device using the pressure sensitive switch have an advantage in that various operations can be performed in a simple manner and are useful for the use of various electronic devices.

What is claimed is:

1. A pressure sensitive switch comprising:

a cover;

a slide portion that is stored in the cover and is slidable by being pressed in a horizontal direction;

a pressing unit including a pressure portion that has an inner side face brought into contact with the slide portion and can be moved by being pressed by the slide potion;

a sheet resistive body that has an upper face brought into contact with the pressing unit; and a conductive plate that is disposed on a lower side of the sheet resistive body with a predetermined gap arranged therebetween, wherein the slide portion is slidable within a horizontal plane, and wherein the pressing portion presses the sheet resistive body by sliding the slide portion, and a resistance value between the sheet resistive body and the conductive plate changes in accordance with a change in a slide operation force for sliding the slide portion.

2. The pressure sensitive switch of claim 1, wherein a hole perforated through the cover to the conductive plate is formed in the cover, the slide portion, the sheet resistive body, and the conductive plate.

3. The pressure sensitive switch of claim 1, wherein the slide portion and the pressing unit are integrally configured as a slide pressing unit.

4. The pressure sensitive switch of claim 1, wherein the sheet resistive body is in the shape of a ring, an arc, or a spiral.

5. An input device comprising:

the pressure sensitive switch of claim 4;

a switch unit that is connected to the pressure sensitive switch;

a control unit that is connected to the pressure sensitive switch and the switch unit; and a constant voltage power supply of a predetermined voltage, wherein a terminal of the pressure sensitive switch that is connected to the sheet resistive body is connected to the constant voltage power supply, and a terminal of the pressure sensitive switch that is connected to the conductive plate is connected to the control unit, and wherein the control unit estimates a pressing direction in which the sheet resistive body is pressed based on an input voltage input to the control unit through the conductive plate.

6. The pressure sensitive switch of claim 1, wherein the pressing portions are disposed at least on front, rear, left, and right sides of the slide portion.

7. The input device of claim 5, wherein the sheet resistive body is connected to a plurality of terminals in different places, wherein the plurality of terminals each at least includes:

a terminal connected to the constant voltage power supply; and a terminal connected to an earth terminal, wherein the switch unit can independently switch connections of the plurality of terminals, and wherein the control unit measures a plurality of the input voltages by switching the connections of the plurality of terminals, and estimates a pressing direction in which the sheet resistive body is pressed based on the plurality of the input voltages.

8. The input device of claim 7, wherein the plurality of terminals include:

a first terminal that is connected to the constant voltage power supply;

a fourth terminal that is connected to the constant voltage power supply;

a second terminal that is connected to the earth electric potential; and a third terminal that is connected to a ground electric potential, wherein the switch unit includes:

a first switch that switches a connection between the first terminal and the constant voltage power supply;

a fourth switch that switches a connection between the fourth terminal and the constant voltage power supply;

a second switch that switches a connection between the second terminal and the ground electric potential;

a third switch that switches a connection between the third terminal and the ground electric potential; and a fifth switch that switches a connection between a terminal connected to the conductive plate and the conductive plate, wherein the control unit detects a first input voltage by connecting the first switch, opening the second switch, connecting the third switch, opening the fourth switch, and opening the fifth switch as a first estimation means, wherein the control unit detects a second input voltage by opening the first switch, connecting the second switch, opening the third switch, connecting the fourth switch, and opening the fifth switch as a second estimation means, and wherein the control unit estimates the pressing direction in which the sheet resistive body is pressed based on the first input voltage and the second input voltage.

* * * * *